United States Patent [19]

Herman

[11] 3,956,751

[45] May 11, 1976

[54] MINIATURIZED TUNABLE ANTENNA FOR GENERAL ELECTROMAGNETIC RADIATION AND SENSING WITH PARTICULAR APPLICATION TO TV AND FM

[76] Inventor: Julius Herman, 3906 Bel Pre Road, Silver Spring, Md. 20906

[22] Filed: Dec. 24, 1974

[21] Appl. No.: 536,168

[52] U.S. Cl. ..... 343/744; 343/882; 343/895

[51] Int. Cl.[2] ..... H01Q 1/36

[58] Field of Search ..... 343/742, 743, 744, 895, 343/748, 882

[56] References Cited

UNITED STATES PATENTS

| | | | |
|---|---|---|---|
| 2,657,312 | 10/1953 | Saranga | 343/744 |
| 3,005,982 | 10/1961 | Bernfeld | 343/742 |
| 3,261,019 | 7/1966 | Lundy | 343/742 |
| 3,534,372 | 10/1970 | Scheuerecker et al. | 343/742 |
| 3,560,983 | 2/1971 | Willie et al. | 343/744 |
| 3,780,373 | 12/1973 | Holst | 343/895 |

*Primary Examiner*—Eli Lieberman

*Attorney, Agent, or Firm*—Cameron, Kerkam, Sutton, Stowell & Stowell

[57] ABSTRACT

A miniaturized thin-wire multi-turn series-connected helical loop antenna, the volutes of which are concentric turns, closely spaced so as to exhibit strong mutual coupling effects. A lumped impedance, fixed or variable, is disposed electrically in series with one of the turns, and a selectively actuable multi-position switch interconnects the turns and the lumped impedance to maximize efficiency.

19 Claims, 8 Drawing Figures

MINIATURIZED TUNABLE ANTENNA FOR GENERAL ELECTROMAGNETIC RADIATION AND SENSING WITH PARTICULAR APPLICATION TO TV AND FM

BACKGROUND OF THE INVENTION

1. Field of the Invention

The subject invention relates to miniaturized multi-turn series-connected loop antennas.

2. Description of the Prior Art

The theoretical solution for multi-turn loop antennas, whether transmitting or receiving, is initially based on the solution for a single-turn loop. The single-turn solution can be obtained by considering the antenna to be a transducer which converts concentrated or distributed voltages into distributed fields and vice-versa. The phenomenon which accomplishes this is the flow of current on the antenna conductor. Thus, if one can postulate the true form of the current and the resulting fields in space in response to timevarying driving forces, the solution for the single-turn loop, whether transmitting or receiving, can be obtained.

A previous patent issued to me on Feb. 19, 1963, U.S. Pat. No. 3,078,462, was titled "One-Turn Loop Antenna". This patent discloses the basic solution for a thinwire, one-turn loop antenna in air, without and with inserted impedances. Although the one turn loop antenna described in the aforesaid patent was a distinct advance over available loop antennas, its limitation to a single loop design subjects it to several limitations. The extension of the theoretical analysis of the operational characteristics to multi-turn loop antennas had not been accomplished, probably because of the difficulty in developing a solution which takes into account the interconnection discontinuity between turns of a multi-turn series connected loop antenna having concentric planar turns.

Without such a usable theoretical analysis, prediction of the operation of a multi-turn loop, or the effects of various modifications thereof are well-nigh impossible. As a result, the development of loop antennas today has not progressed much beyond the level of my aforesaid patent.

I have now developed a complete mathematical theory for the characteristics of a multi-turn, series-connected loop antenna formed of planar turns that are closely spaced and exhibit strong mutual coupling effects. The theory from which the multi-turn loop has been developed is applicable not only to miniaturized antennas, but to any electrical size. Hence, the ability to control radiation coverage and antenna impedance of a transmitting antenna, and the ability to control response to incident fields and the antenna impedance of a receiving antenna, apply also to an antenna of any electrical size constructed in accordance with the principles and teachings of the present invention.

SUMMARY OF THE INVENTION

The present invention relates to a multi-turn thinwire series-connected loop antenna formed of, planar concentric turns, cylindrical turns, or any three-dimensional geometric configuration, having turns that are closely spaced so as to exhibit strong mutual coupling effects. A lumped impedance, fixed or variable, is disposed at a selected point in the periphery of one or more turns, and a multi-position switch is interconnected between the turns and the lumped impedance to maximize efficiency. In accordance with the present invention, there is provided a miniaturized antenna capable of achieving high radiation efficiency such as 50% or more for a miniaturized antenna whose maximum dimension is less than 0.07λ over a 10 to 1 frequency range and having an impedance that can be easily adjusted to almost any desired value. The radiation pattern can be selected to conform to many desired coverages.

When utilized for reception, the miniaturized receiving antenna converts incident fields into a maximal signal voltage at the input of a receiver over a frequency range of as much as 16 to 1 by utilizing the ability to control the antenna impedance.

Being miniaturized, the receiving antenna can act as a probe in space so as to finely select and respond to a particular incident field in the presence of a number of simultaneous incident fields. In essence, it can reduce the undesirable "ghost" effect. Such a receiving antenna responds to both horizontally and vertically polarized fields. Hence, its physical attitude can be easily adjusted to provide polarization sensitivity.

Accordingly, it is an object of my invention to provide a miniaturized transmitting antenna in a concentric multi-turn series-connected loop configuration, planar and non-planar, smaller than any other transmitting antenna presently known, where the radiation efficiency is an appreciable fraction of 100%.

Another object of my invention is to provide a miniaturized transmitting antenna in a multi-turn series-connected loop configuration capable of covering frequency bands of as much as 16 to 1: (a) by the use of a single tuning condenser inserted in a single turn of the multi-turn loop; (b) by the use of switches to switch opens to shorts and vice-versa in one or more turns.

A further object of my invention is to provide a transmitting antenna in which, regardless of size, a prescribed and desired field pattern and a desired impedance level can be easily adjusted by using inserted impedances, fixed and/or variable, in one or more turns of a multi-turn loop to select and/or repress particular current modes.

Still another object of my invention is to provide a multi-turn series-connected loop antenna configuration for radiation and/or reception of electromagnetic waves in which turns can be connected in single spiral form, in double spiral form, in reversed turn form, and in partial turn form, so as to achieve characteristics such as broad-banding, field pattern control, impedance level control.

Another object of my invention is to provide a miniaturized passive probe antenna in a concentric multi-turn series-connected loop configuration, planar and non-planar, for reception of VHF black and white and color TV and FM, with maximum loop antenna diameter being less than five inches.

A further object of my invention is to provide a miniaturized passive probe antenna for VHF black and white and color TV and FM, capable of minimizing "ghosts" by universal adjustment of the plane of the multi-turn series-connected loop.

Another object of the invention is to provide a miniaturized passive probe antenna for VHF black and white and color TV and FM which uses internal antenna tuning in the form of a single miniature tuning condenser inserted in one turn of a multi-turn series-connected loop to maximize the signal voltage developed across the input impedance of the TV or FM receiving set.

A further object of my invention is to provide a miniaturized passive probe receiving antenna capable of covering frequency bands of as much as 16 to 1 by the use of switching configurations which change opens to shorts and vice-versa in one or more turns of a multi-turn series-connected loop antenna.

A distinct and important advantage of the present invention is that the foregoing objects can be achieved through a frequency spectrum from a few hertz up to the point where physical limitations preclude practical embodiment which is about 5000 MHZ.

BRIEF DESCRIPTION OF THE DRAWINGS

These and other objects of the present invention and the attendant advantages will be more apparent and more readily understood upon reference to the following specification, claims and drawings wherein:

DESCRIPTION OF THE PREFERRED EMBODIMENTS

Inasmuch as an appreciation of the advance and contribution to the art made by the present invention is dependent on an understanding of the mathematics behind the design, the basic solution of one-turn loop antennas and its modification and application to multi-turn series-connected loop antennas will be discussed first.

BASIC SOLUTION OF ONE-TURN LOOP ANTENNA

Figure 1:
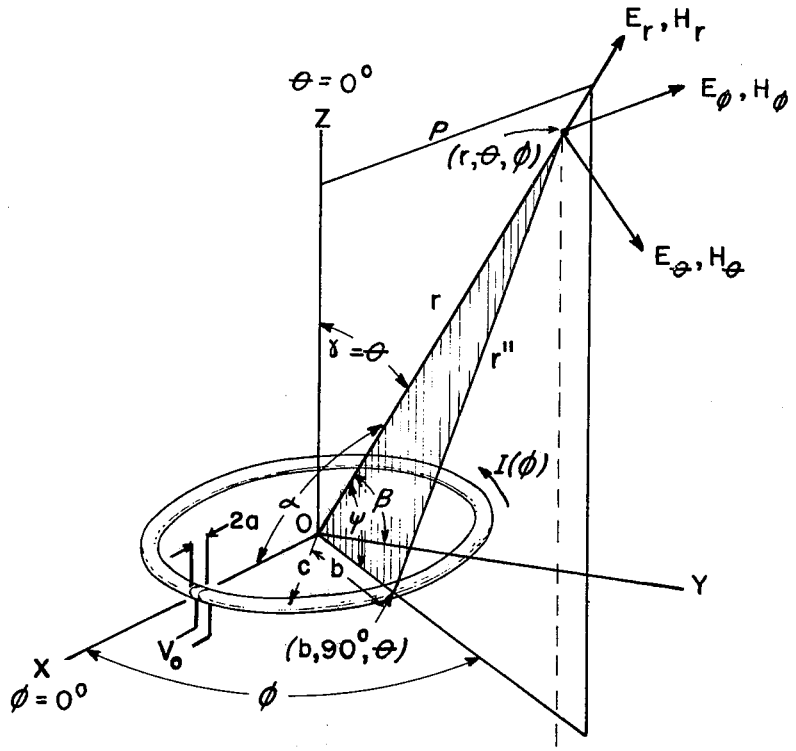
FIG. 1 is a pictorial representation of the spherical geometry employed in formulating the theory of a one-turn, thin-wire loop antenna.

The spherical geometry shown in FIG. 1 is used in formulating the theory. The loop lies in the X—Y plane, the radius to the extreme edge of the loop is c, the wire radius is $a$, and the radius to the center of the loop conductor is $b$. A driving voltage at $\phi = 0°$ causes a counterclockwise current flow around the loop. In general, the current flow can be caused by the single generator $V_o$, by several of these generators at different points on the loop, by a distributed generator such as when the loop is the secondary of a transformer, and by electric fields in space which are incident on the loop. The incorporation of any or all of these into the equation needed to solve the problem will be shown subsequently. In any event, the flow of current, $I(\phi)$, is continuous and hence may be postulated as a Fourier series in the variable $\phi$ as follows:

$$I(\phi) = a_0 + \sum_{k=1}^{\infty} [a_k \cos k\phi + b_k \sin k\phi] \qquad (1)$$

where the current coefficients for each mode, $a_0$, $a_k$, $b_k$ are unknown as yet. For a thin wire, the current can be assumed as filamentary. The solution for the fields in the spherical continuum outside of the loop is now obtained using Maxwell's equations which: relate the electric and magnetic field vectors to the scalar electric wave potential and the vector magnetic wave potential; relate the dependence between vector magnetic wave potential and scaler electric wave potential; and relate the dependence of the magnetic vector wave potential on the integral summation of current moments as modified by the retardation Green's function. The driving forces for the current are assumed to be time-dependent in the well known form of $e^{jwt}$.

Applying the addition and expansion formulas in spherical coordinates to the Green's function, integrating, collecting terms, substituting the magnetic potential components in the electric and magnetic field equations, and using the general spherical wave equations, the resulting fields are expressed as two families of waves, one a family of transverse magnetic waves, TE, and one a family of transverse magnetic waves, TM. In my aforesaid patent, the TM family was expressed as two families, a $TM^a$ and a $TM^b$. I have found, however, that these two families can be consolidated into one TM family.

They are as follows:

TE $$rH_r = \frac{j}{2} \sum_{\substack{n=k+1 \\ k+3,\ldots}}^{\infty} \sum_{k=0,1,2,\ldots}^{n} (2n+1) \frac{(n-k)!}{(n+k)!} \hat{J}_n(\beta_o b) \frac{\hat{H}_n(\beta_o r)}{\beta_o r} p_n^k(\cos\theta) \frac{d}{d\theta} [p_n^k(\cos\theta)] \quad [a_k \cos k\phi + b_k \sin k\phi] \quad \theta = 90°$$

$$rE_\theta = -\frac{\eta_o}{2} \sum_{\substack{n=k+1, \\ k+3,\ldots}}^{\infty} \sum_{K=1,2,\ldots}^{n} \frac{k(2n+1)}{n(n+1)} \frac{(n-k)!}{(n+k)!} \hat{J}_n(\beta_o b) \hat{H}_n(\beta_o r) \frac{p_n^k(\cos\theta)}{\sin\theta} \frac{d}{d\theta} [p_n^k(\cos\theta)] \quad [a_k \sin k\phi - b_k \cos k\phi] \quad \theta = 90°$$

$$rH_\phi = -\frac{j}{2} \sum_{\substack{n=k+1, \\ k+3,\ldots}}^{\infty} \sum_{k=1,2,\ldots}^{n} \frac{k(2n+1)}{n(n+1)} \frac{(n-k)!}{(n+k)!} \hat{J}_n(\beta_o b) \hat{H}_n'(\beta_o r) \frac{p_n^k(\cos\theta)}{\sin\theta} \frac{d}{d\theta} [p_n^k(\cos\theta)] \quad [a_k \sin k\phi - b_k \cos k\phi] \quad \theta = 90°$$

$$rE_\phi = -\frac{\eta_o}{2} \sum_{\substack{n=k+1, \\ k+3,\ldots}}^{\infty} \sum_{k=0,1,2,\ldots}^{n} \frac{(2n+1)}{n(n+1)} \frac{(n-k)!}{(n+k)!} \hat{J}_n(\beta_o b) \hat{H}_n(\beta_o r) \frac{d}{d\theta} p_n^k(\cos\theta) \frac{d}{d\theta} [p_n^k(\cos\theta)] \quad [a_k \cos k\phi + b_k \sin k\phi] \quad \theta = 90°$$

$$rH_\theta = \frac{j}{2} \sum_{\substack{n=k+1,\\ k+3,\ldots}}^{\infty} \sum_{k=0,1,2,\ldots}^{n} \frac{(2n+1)}{n(n+1)} \frac{(n-k)!}{(n+k)!} \hat{J}_n(\beta_o b)\hat{H}_n'(\beta_o r) \frac{d}{d\theta}[p_n^k(\cos\theta)] \frac{d}{d\theta}[p_n^k(\cos\theta)] \Big|_{\theta=90^\circ} [a_k \cos k\phi + b_k \sin k\phi]$$

TM $$rE_r = -\frac{\eta_o}{2} \sum_{\substack{n=k,\\ k+2,\ldots}}^{\infty} \sum_{k=1,2,\ldots}^{n} k(2n+1) \frac{(n-k)!}{(n+k)!} \hat{J}_n'(\beta_o b) \frac{\hat{H}_n(\beta_o r)}{\beta_o r} p_n^k(\cos\theta) p_n^k(o)[a_k \sin k\phi - b_k \cos k\phi]$$

$$rE_\theta = -\frac{\eta_o}{2} \sum_{\substack{n=k,\\ k+2,\ldots}}^{\infty} \sum_{k=1,2,\ldots}^{n} \frac{k(2n+1)}{n(n+1)} \frac{(n-k)!}{(n+k)!} \hat{J}_n'(\beta_o b)\hat{H}_n'(\beta_o r) \frac{d}{d\theta}[p_n^k(\cos\theta)] p_n^k(o)[a_k \sin k\phi - b_k \cos k\phi]$$

$$rH_\phi = \frac{j}{2} \sum_{\substack{n=k,\\ k+2,\ldots}}^{\infty} \sum_{k=1,2,\ldots}^{n} \frac{k(2n+1)}{n(n+1)} \frac{(n-k)!}{(n+k)!} \hat{J}_n'(\beta_o b)\hat{H}_n(\beta_o r) \frac{d}{d\theta}[p_n^k(\cos\theta)] p_n^k(o)[a_k \sin k\phi - b_k \cos k\phi]$$

$$rE_\phi = -\frac{\eta_o}{2} \sum_{\substack{n=k,\\ k+2,\ldots}}^{\infty} \sum_{k=1,2,\ldots}^{n} \frac{k^2(2n+1)}{n(n+1)} \frac{(n-k)!}{(n+k)!} \hat{J}_n'(\beta_o b)\hat{H}_n'(\beta_o r) \frac{p_n^k(\cos\theta)}{\sin\theta} p_n^k(o)[a_k \cos k\phi + b_k \sin k\phi]$$

$$rH_\theta = -\frac{j}{2} \sum_{\substack{n=k,\\ k+2,\ldots}}^{\infty} \sum_{k=1,2,\ldots}^{n} \frac{k^2(2n+1)}{n(n+1)} \frac{(n-k)!}{(n+k)!} \hat{J}_n'(\beta_o b) \hat{H}_n(\beta_o r) \frac{p_n^k(\cos\theta)}{\sin\theta} p_n^k(o)[a_k \cos k\phi + b_k \sin k\phi]$$

The dependence of the fields on the three spherical coordinates, $[r,\theta,\phi]$, is that of a product of functions of each coordinate. The electric fields are represented by E, the magnetic fields by H. The nomenclature used above as follows:

$\eta_o$ = impedance of free space = $12_o\pi_{ohms}$
j = $\sqrt{-1}$
$\beta_o$ = propagation constant in free space = $2\pi/\lambda_o$
$\lambda_o$ = free space wavelength corresponding to the frequency used
$\hat{J}_n(\beta_o b)$ = spherical Bessel function with argument $(\beta_o b)$
$\hat{J}_n'(\beta_o b)$ = derivative of $\hat{J}_n(\beta_o b)$ with respect to the argument $(\beta_o b)$
$\hat{H}_n(\beta_o r)$ = spherical Hankel function of the second kind with argument $(\beta_o r)$
It is equal to $[\hat{J}_n(\beta_o r)-j\hat{N}_n(\beta_o r)]$ Hn $(\beta_o r)$ = derivative of $H_n(\beta_o r)$ with respect to $(\beta_o r)$
$P_n^k(\cos\theta)$= associated Legendre polynomial with argument $(\cos\theta)$ The vector components of the electric and magnetic fields are shown in FIG. 1. The unknown constants in the field equations are the current coefficients of each current mode, $a_k$, and $b_k$. To determine them, it is necessary to resort to the boundary condition at a physical discontinuity in space, in this case, the extreme outer edge of the loop conductor ($r=c$, $\theta=90°$). Assuming a perfect conductor, the electric field, $E_\phi$ , tangential to the loop peripheral surface must be zero everywhere at the surface. If this were not so, an infinite current would flow in response to a net electric field. If the conductor is not perfect, the tangential electric field must be continuous across the surface into the conductor. This implies that the external electric field at the surface must be equal to the internal electric field at the surface. If the internal field is expressed equivalently as the product of internal impedance per unit length and current, then the equality can be expressed as follows:

$$E_\phi^{ext} = E_\phi^{int} = Z^i I(\Phi) \tag{2}$$

or $$[E_\phi^{ext} - Z^i I\Phi] = E_\phi^{total} = 0$$

This equation is the same as that for a perfect conductor in which the total tangential electric field at the surface is zero. In essence, we have accounted for the finite conductivity by replacing its effect by an electric field which is a contribution to the total electric field. This equation is a point relationship.

If an open, or a finite physically small impedance, or a physically small driving voltage source, is placed in the loop periphery at a point, then at that point, there is a contribution to the total external tangential electric field in addition to that caused by the current flow. This contribution can be accounted for in Eq.(2) by the use of the wellknown mathematical concept of a slice or delta function generator or sink so that the electric field at the point exists only at the point or gap. This delta function generator or sink is defined as an infinite electric field in a region of infinitesimal length having a line integral across the region which is finite and equal to the voltage at the point or gap. At the outer edge of the loop conductor where $r=c$ and $\phi=\phi_a$, the delta function relation is:

$$E\phi^{gap} = 1/c\ V_a^{gap}\delta(\Phi-\Phi_a) \tag{3}$$

Taking the line integral across an infinitesimal gap extending from $-\delta/2$ to $+\delta/2$:

$$\int_{-\delta/2}^{\delta/2} E_\phi^{gap}\, c\,d\phi = \int_{-\delta/2}^{\delta/2} V_a^{gap}\,\delta(\phi-\phi_a)\,d\phi = V_a^{gap} \tag{4}$$

The integral of a delta function limits the value of the integral to that of the function modifying the delta function, in this case $V_a^{gap}$. The integral is also zero everywhere but at the point $\phi = \phi_a$. Obviously, if the modifying function exists only at $\phi = 0°$, the delta function would be $\delta(\phi)$. The delta function, $\delta(\phi - \phi_a)$, can be designated as a translated delta function.

It is informative to state two other conditions; firstly, that external electric fields arising from sources other than in the loop must be included in the left side of Eq. (2); secondly, the algebraic sign of a point delta function field is taken as positive in the left side of Eq. (2) if it arises from a voltage source whose polarity drives current counterclockwise, and negative if it arises from a gap or impedance since it would then be a voltage sink. The first condition can arise in various ways, such as a plane wave from a distance source which arrives at the loop, or a mutually coupled field from a nearby source. The differentiation implied here between a distant source and a nearby source is that there is mutual interaction among nearby sources, but negligible interaction with distant sources.

Continuing the solution for the single-turn loop to determine the current coefficients, let us assume a delta function generator with voltage $V_o$ is applied at $\phi = 0°$ as shown in FIG. 1. Then Eq. (2) becomes:

$$E_\phi \; {}^{ext}_{TE} + E_\phi \; {}^{ext}_{TM} + \frac{1}{c} V_o \, \delta(\phi) - Z^I I(\phi) = 0 \qquad (5)$$

Substituting the values of $E_\phi$ at $r = c$, $\theta = 90°$ from the TE and TM wave families:

$$V_o\delta(\phi) = \frac{\eta_o}{2} \sum_{\substack{n=k+1,\\ k+3,\ldots}}^{\infty} \sum_{k=0,1,2,\ldots}^{n} \frac{(2n+1)}{n(n+1)} \frac{(n-k)!}{(n+k)!} \hat{J}_n(\beta_o b)\hat{H}_n(\beta_o c) \left\{ \frac{d}{d\theta} \left[ p_n^k(\cos\theta) \right]_{\theta=90°} \right\}^2 [a_k \cos k\phi + b_k \sin k\phi]$$

$$+ \frac{\eta_o}{2} \sum_{\substack{n=k\\ k+2,\ldots}}^{\infty} \sum_{k=1,2,\ldots}^{n} \frac{k^2(2n+1)}{n(n+1)} \frac{(n-k)!}{(n+k)!} \hat{J}_n'(\beta_o b)\hat{H}_n'(\beta_o c) \left[ p_n^k(o) \right]^2 [a_k \cos k\phi + b_k \sin k\phi]$$

$$+ cZ^I \left[ a_o + \sum_{k=1,2,\ldots}^{\infty} (a_k \cos k\phi + b_k \sin k\phi) \right] \qquad (6)$$

The use of orthogonality relations results in a determination of the current coefficients in terms of known values. Thus, integrating around the loop over $\phi$ from $o$ to $2\pi$, $a_0$ is found immediately as:

$$a_o = \frac{V_o}{Z_{os} + Z_t} \qquad (7)$$

where $Z_{os}$ = the impedance looking into the loop for the zero mode, $k = o$, for a perfect conductor; and $Z_t$ = the total internal impedance around the loop.

In terms of the functions shown in Eq.(6):

$$Z_{os} = \pi\eta_o \sum_{n=1,3,5,\ldots}^{\infty} \frac{(2n+1)}{n(n+1)} \hat{J}_n(\beta_o b)\hat{H}_n(\beta_o c) \left[ p_n'(o) \right]^2 \qquad (8)$$

Multiplying both sides of Eq.(6) by $\cos\phi$ and integrating from $o$ to $2\pi$:

$$a_k = \frac{V_o}{Z_{ks} + \frac{Z_t}{2}} \qquad (9)$$

Where $Z_{ks}$ = the perfect conductor $k$ mode impedance looking into the loop.

Again, in terms of the functions shown in Eq.(6):

$$Z_{ks} = \pi\eta_o \sum_{\substack{n=k+1,\\ k+3,\ldots}}^{\infty} \frac{(2n+1)}{2n(n+1)} \frac{(n-k)!}{(n+k)!} \hat{J}_n(\beta_o b)\hat{H}_n(\beta_o c) \left[ p_n^{k+1}(o) \right]^2$$

$$+ \pi\eta_o \sum_{\substack{n=k,\\ k+2,\ldots}}^{\infty} \frac{k^2(2n+1)}{2n(n+1)} \frac{(n-k)!}{(n+k)!} \hat{J}_n'(\beta_o b)\hat{H}_n'(\beta_o c) \left[ p_n^k(o) \right]^2 \qquad (10)$$

$$\text{or } Z_{ks} = Z_{ksTE} + Z_{ksTM} \qquad (11)$$

Multiplying both sides of Eq.(6) by $\sin k\phi$ and integrating from $o$ to $2\pi$:

$b_k = o$ (because the delta function picks the value of $\sin k\phi$ at $\phi = 0°$ (12)

The external tangential electric field at $r = c$ due to current flow can be rewritten in general, as:

$$E_\phi{}^I(\phi) = -\frac{a_o}{2\pi c} Z_{os} - \frac{1}{\pi c} \sum_{k=1}^{\infty} [a_k \cos k\phi + b_k \sin k\phi] Z_{ks} \qquad (13)$$

where the superscript I refers to the external induced field

The impedance looking into the loop (and admittance) is:

$$Z_{in} = \frac{V_o}{I(o)}$$

$$\text{or } Y_{in} = \frac{I(o)}{V_o} = [Y_o + \sum_{k=1}^{\infty} Y_k] \qquad (14)$$

$$\text{where } Y_o = \frac{1}{Z_{os} + Z_t} \qquad (15)$$

$$Y_k = \frac{1}{Z_{ks} + \frac{Z_t}{2}} \tag{16}$$

The final step in the solution of a single-turn loop is to incorporate the effect of one or more lumped impedances inserted in the loop periphery. To show this, let us take a specific example, an impedance inserted at $\phi$=180°. Then the left side of Eq.(5) would have an added term:

$$\left.\begin{array}{ll} -\frac{1}{c}V_{180°} & \delta(\phi - 180°) \text{ or } E_{\phi\,180°} \\ \text{also } V_{180°} = Z_{180°} & I(180°) \\ \text{or } V_{180°}Y_{80°} & = I(180°) \end{array}\right\} \tag{17}$$

The negative sign in the first relation of Eq.(17) accounts for the fact that the voltage across the impedance $Z_{180°}$ is equivalent to a delta function sink. The left side of Eq.(6) would now become:

$[V_o\delta(\phi) - V_{180°}\delta(\phi - 180°)]$ Eq. (6) modified

Applying orthogonality relations as before results in the following:

$$\left.\begin{array}{l} a_k = Y_k[V_o - (-1)^k V_{180°}] \\ b_k = 0 \end{array}\right\} \quad k=0,1,\ldots\infty \tag{18}$$

or $$\frac{a_k}{V_o} = Y_{kin} = Y_k\left[1-(-1)^k\frac{V_{180°}}{V_o}\right] \tag{19}$$

Note that the mode admittances, $Y_{kin}$, are now given in terms of the mode admittances, $Y_k$, with no inserted impedance, and the ratio of voltage across the inserted impedance to the driving voltage, $V_{180°}/V_o$. From Eq. (17):

$$\frac{V_{180°}}{V_o} Y_{180°} = \sum_{k=0,1,2,\ldots}^{\infty} (-1)^k \frac{a_k}{V_o} \tag{17}$$

Substituting Eq. (19) in Eq. (17) and solving for $V_{180°}/V_o$:

$$\frac{V_{180°}}{V_o} = \frac{\sum_{k=o,1,2}^{\infty} (-1)^k Y_k}{Y_{180°} + \sum_{k=o,1,2}^{\infty} Y_k} \tag{20}$$

Since the right side of Eq.(20) consists of known admittance, the voltage ratio is now a known quality. Substitution in Eq.(19) and summation over $k$ yields the new value for the input admittance with an impedance inserted at $\phi = 180°$.

The solution for an impedance inserted at any $\phi$ or for any number of impedances is easily obtained. Thus, for a number of inserted impedances at various points, $a$, there will be an equal number of equations similar to Eq.(17) but with the term on the right side, $(-1)^k$Ak, replaced by $[a_k\cos k\phi n + b_k\sin k\phi a]$ where each $\phi a$ is given. Also, in addition to an equal number of equations, similar to Eq.(19), there will be an equal number of equations for $b_k/V_o$. Substitution of three equations for $a_k/V_o$ and $b_k/V_o$ in each new Eq.(17) and simultaneous solution of all the new Eq.(17)'s will yield all the voltage ratios.

BASIC SOLUTION FOR ELECTROMAGNETIC SENSING BY A THINWIRE ONE-TURN LOOP

A. GEOMETRIC RELATIONS

FIG. 1 illustrates the geometry for a loop antenna lying in the X–Y plane of a spherical co-ordinate system. The voltage, $V_o$, at $\phi=0°$ is now, however, the voltage developed across a load impedance rather than a driving voltage.

The first geometric relation needed is the angle between two finite length lines which do not meet. This angle is defined as that between two intersecting lines parallel to the given lines and having the same positive directions in terms of their direction cosines. Thus, for example, in FIG. 1, if $r$ is a line through the origin which represents a parallel line which originally did not pass through the origin, and $b$ represents another similar line, the angle between them is given by:

$$\cos\psi = \cos\alpha_1\cos\alpha_2 + \cos\beta_1\cos\beta_2 + \cos\gamma_1\cos\gamma_2 \tag{21}$$

Where $\alpha_n$ = angle a line makes with the +X axis $\beta_n$ = angle a line makes with the +Y axis $\gamma_n$ = angle a line makes with the +Z axis The direction cosines of the line $r$, in terms of the coordinate angles $\theta$ and $\phi$ of the line are:

$$\left.\begin{array}{l} \cos\alpha_r = \sin\theta\cos\phi \\ \cos\beta_r = \sin\theta\sin\phi \\ \cos\gamma_r = \cos\theta \end{array}\right\} \tag{22}$$

Given a line in space which does not pass through the origin, its direction cosines are found by first translating the line parallel to itself so as to pass through the origin, and then calculating the polar and azimuthal angles, $\theta$ and $\phi$, of the translated line. Now consider the two systems of three vectors in FIG. 1, ($E_r$, $E_\theta$, $E_\phi$) or ($H_r$, $H_\theta$, $H_\phi$). For either one, the $r$ direction vector lies along $r$, the $\theta$ direction vector is normal to $r$ and lies in the plane described by $r$ and the Z axis, the $\phi$ direction vector is normal to $r$ and also normal to the plane described by $r$ and the Z axis. This plane is usually called the plane of incidence. The three vectors are always in the direction of increasing value of the coordinates, r, $\theta$, $\phi$. They form a CCW system. It is required to find the direction cosines of the three vectors when the radius vector to the point P may lie anywhere in $4\pi$ steradians.

Analyzing the eight cubical spaces in which the radius vector may lie, the direction cosines of the three vectors are found to be the following:

$$\begin{array}{lll} \cos\alpha_{E_r} = \sin\theta\cos\phi & \cos\alpha_{E_\theta} = \cos\theta\cos\phi & \cos\alpha_{E_\phi} = -\sin\phi \\ \cos\beta_{E_r} = \sin\theta\sin\phi & \cos\beta_{E_\theta} = \cos\theta\sin\phi & \cos\beta_{E_\phi} = \cos\phi \\ \cos\gamma_{E_r} = \cos\theta & \cos\gamma_{E_\theta} = -\sin\theta & \cos\gamma_{E_\phi} = 0 \end{array} \tag{23}$$

The $\theta$ and $\phi$ coordinate values above are those for the radius vector, $r$.

A second geometric relation needed is the equation for the normal distance from a plane in space to any point in space. If we allow $r_o$ to represent the normal to the plane from an origin of coordinates, then the normal distance from the plane to any point $(x,y,z)$ is:

$$d_{(x,y,z)} = r_o - (x\cos\alpha_{ro} + y\cos\beta_{ro} + z\cos\gamma_{ro}) \quad (24)$$

B. SOLUTION FOR SINGLE PLANE WAVE INCIDENT ON LOOP

In FIG. 1, assume a plane wave incident on the loop.

Let $r$ be the radius vector $r_o$, normal to the plane wave front. Let $\theta = \theta_o$ and $\phi = \phi_o$ specify the orientation of $r_o$ relative to the spherical coordinate system. Let $E_\phi$ and $E_\theta$ of FIG. 1 be two electric fields, $E_n e^{j\alpha_1}$ and $E_p e^{j\alpha_2}$ respectively which are contained in the plane wave front. The phase factor for each, $\alpha_1$ and $\alpha_2$, is considered to be the value of the phase of each at the origin of the loop coordinates. The two different phase factors imply an elliptically polarized wave, the most general case in plane waves. The $E_N$ field is normal to the plane of incidence defined by the $r_o$—Z axis vectors, while the $E_p$ field is parallel to the plane of incidence and lies in it. The variation in magnitude of each field as each passes across the loop can be considered to be negligible. The change in phase, however, in traversing the loop, is not.

The incident plane wave causes a flow of current in the loop, assumed in the CCW direction. Hence, a load, $Z_l$, placed across the $V_o$ terminals at $\phi = 0°$ will exhibit a voltage. It is required to find this signal, $V_l$.

The direction cosines of Eq.(23) will be used in conjunction with the direction cosines of the tangent line to any point on the loop to find the tangential projection of the incident fields on the loop. If $\phi_l$ is the azimuthal coordinate of the radius vector to any point on the loop, ($\theta_l = 90°$), then the direction cosines of the tangent are:

$$\cos\alpha_t = -\sin\phi_l \quad \cos\beta_t = \cos\phi_l \quad \cos\gamma_t = 0 \quad (25)$$

Using Eqs. (21), (23), and (25), and neglecting phase change momentarily, the tangential projections of the incident fields are:

$$E\phi_N = E_{Ne}{}^{j\alpha_1} \cos[\phi_o - \phi_l] \quad (26)$$

$$E\phi_p = E_{pe}{}^{j\alpha_2} \cos\Theta_o \sin[\phi_o - \phi_l] \quad (27)$$

To incorporate phase change, assume that the phase reference point is at the center of the loop. The $(x,y,z)$ coordinates of any point on the loop are:

$$\left.\begin{aligned} x &= c\cos\phi_l \\ y &= c\sin\phi_l \\ z &= 0 \end{aligned}\right\} \quad (28)$$

Substituting Eqs. (22) and (28) in (24):

$$d_{(x,y,z)} = r_o - c\sin\theta_o\cos[\phi_o - \phi_l] \quad (29)$$

The phase delay is expressed by $e^{-j\beta_o d(x,y,z)}$. Since the phase reference is taken at the origin, it is necessary to substract $\beta_o r_o$ from $\beta_o d_{(x,y,z)}$.

Hence, the phase factor required is:

$$e^{j(\beta_o d(x,y,z) - \beta_o r_o)} = e^{j\beta_o c\sin\theta_o \cos(\phi_o - \phi_l)} \quad (30)$$

Thus, the tangential projections of the incident fields, including the variation in phase across the loop, are:

$$E\phi_N = \left[E_n e^{j\alpha_1} e^{j\beta_o c\sin\theta_o \cos(\phi_o - \phi_l)}\right] \cos(\phi_o - \phi_l) \quad (31)$$

$$E\phi_p = \left[E_p e^{j\alpha_2} e^{j\beta_o c\sin\theta_o \cos(\phi_o - \phi_l)}\right] \sin(\phi_o - \phi_l)\cos\theta_o \quad (32)$$

Refer now to the boundary condition equation, Eq. (5) which should now be rewritten as follows:

$$E_\phi{}^I + E_\phi{}^{ext} - (1/c)\, V_l\, \delta(\phi) - Z^I I(\phi) = 0 \quad (33)$$

where $E_\phi{}^I$ = external field due to current flow $E_\phi{}^{ext}$ = external field incident on loop $-1/c\ V_l\ \delta(\phi)$ = point field in loop at $\phi = o$ due to current in load $Z^I I(\phi)$ = internal electric field due to finite conductivity Substitution of Eq. (13) for $E_\phi{}^I$ and applying orthogonality relations and integration as before:

$$a_k = \frac{-V_l + C\int_o^{2\pi} E_\phi{}^{ext}\cos k\phi d\phi}{Z_k} \quad k = 0,1,2\ldots\infty \quad (34)$$

$$b_k = \frac{c\int_o^{2\pi} E_\phi{}^{ext}\sin k\phi d\phi}{Z_k} \quad k = 1,2,\ldots\infty \quad (35)$$

Now $$V_l Y_l = I(o°) = [a_o + \sum_{k=1,2,\ldots}^{\alpha} a_k] \quad (36)$$

Substituting from Eq.(34):

$$V_l Y_l + V_l \sum_{k=0,1\ldots}^{\alpha} \left[\frac{1}{Z_k}\right] = c \sum_{k=0,1,\ldots}^{\alpha} \int_o^{2\pi} \left[\frac{\cos k\phi E_\phi{}^{ext} d\phi}{Z_k}\right] \quad (37)$$

From Eq.(14), the second term on the left is $V_l Y_{in}$ where $Y_{in}$ is the loop input admittance. Hence:

$$V_l = \frac{\frac{s}{2}\sum_{k=0,1,\ldots}^{\infty}\left[\frac{Y_k}{\pi}\int_o^{2\pi} \cos k\phi E_\phi{}^{ext} d\phi\right]}{Y_l + Y_{in}} \quad (38)$$

where S = circumference of loop $= 2\pi c$

Note that in Eq.(34), if $E_\phi{}^{ext}$ is zero, summing both sides over $k$ would yield:

$$Y_{in} = \frac{-V_l}{I(o°)} \quad (39)$$

This states that the input impedance to the loop is the negative ratio of $V_l/T(0°)$. Since $V_l$ was taken as a voltage drop, this result is consistent.

As in the single-turn loop solution previously derived, the effect of other inserted impedances anywhere in the loop can be easily found by adding terms of the type $-1/c\ V_{\phi a}\delta(\phi-\phi a)$ to the left side of Eq.(33) and following the same solution procedure as previously.

The next step in the solution is to substitute the value for the incident field, which is the sum of Eq.(31) and Eq.(32), in Eq.(38). The exponential factor in the incident field can be expanded using the formula:

$$e^{jM\cos\epsilon} = J_o(M)+2\sum_{q=1}^{\infty}(-1)^q J_{2q}(M)\cos 2q\epsilon + 2j\sum_{q=0}^{\infty}(-1)^q J_{2q+1}(M)\cos(2q+1)\epsilon \qquad (40)$$

where $M=\beta_o c\sin\theta_o$ $$\cos\epsilon = \cos(\phi_o-\phi_l)$$

$J_z(M)$ = cylindrical Bessel function

The details of the integration of the expanded form of Eq.(38) which now incorporates a double summation, over $k$ and $q$, are lengthy but simple. Consolidation of the final result is achieved by the use of the following recursion relations:

$$J_{q-1}(x)-J_{q+1}(x) = 2J_q'(x) \qquad (41)$$

$$J_{q-1}(x)+J_{q+1}(x) = \frac{2q}{x}J_q(x) \qquad (42)$$

where $J_q'$ = derivative of $J_q$ with respect to $x$

The final equation is the following:

$$V_l = -jS\frac{\sum_{k=0}^{\infty}(-1)^{k/2}Y_k[E_N\cos k\phi_o J_k'(\beta_o c\sin\theta_o)e^{j\alpha_1}+E_p\sin k\phi_o\frac{k\cos\theta_o}{\beta_o c\sin\theta_o}J_k(\beta_o c\sin\theta_o)e^{j\alpha_2}]}{Y_l+Y_{in}} \qquad (43)$$

The open-circuit voltage developed is obtained by allowing $Y_l$ to equal zero. The ratio of $V_l$ to $V_{oc}$ is:

$$\frac{V_l}{V_{oc}} = \frac{Y_{in}}{Y_l+Y_{in}} = \frac{Z_l}{Z_l+Z_{in}} \qquad (44)$$

The equivalent circuit is a simple series circuit represented by a generator of voltage $V_{oc}$ with an internal impedance of $Z_{in}$, in series with a load $Z_l$. Any other external fields present can be accounted for by adding them, with their specific values of $\theta_o$, $\phi_o$ and $\alpha$, to the right side of Eq.(43).

In the case of a very small electrical size loop in which only the k=0 mode need be considered, and with the radius vector to the plane wave front lying in the X—Y plane, the open-circuit voltage, from Eq.(43), becomes the well-known equation:

$$V_{oc} = -j\omega\mu_o H \qquad (45)$$

In general, the signal voltage is dependent upon the mode admittances (impedances). Hence, it is useful to know their characteristics relative to each other and relative to frequency. While I have developed and published curves showing these impedances over an electric circumferential range up to $s/\lambda$ equal to 2.4, I am mainly interested here in somewhat small electrical loops, 0.2λ in circumference or less. The perfect conductor mode impedances for such size loops are the following:

1. The zero mode impedance is basically a small inductive reactance, hence a large admittance. Impedance increases with frequency.
2. The unity mode impedance is mainly a fairly large capactive reactance, hence a small admittance. The impedance decreases with frequency. However, over the range up to 0.2λ, its magnitude is still much larger than that of the zero mode.
3. The higher order mode impedances are increasingly much larger capacitive reactances than that of the unity mode. Over the range up to 0.2λ, the admittances of the modes higher than the unity one can be neglected without introducing significant errors.

Based on the above considerations, Eq.(43) will be expanded in the zero and unity modes. In addition, for $x$ less than 0.2λ, $J_n(x)$ is closely equal to $X^n/n!2^n$ and:

$$\left.\begin{aligned} J_o'(x) &= -J_1(x) = \frac{-x}{2} = \frac{-\beta_o c\sin\theta_o}{2} \\ J_1'(x) &= \frac{J_o(x)-J_2(x)}{2} = \tfrac{1}{2} - \frac{(\beta_o c\sin\theta_o)^2}{16} \approx \tfrac{1}{2} \end{aligned}\right\} \qquad (46)$$

Then Eq.(43) becomes:

$$V_l = j\frac{S}{2}\left\{\frac{[Y_o\beta_o c\sin\theta_o - jY_1\cos\phi_o]E_N e^{j\alpha_1} - jY_1\sin\phi_o\cos\theta_o F_p e^{j\alpha_2}}{Y_l+Y_o+Y_1}\right\} \qquad (47)$$

Obviously, signal voltage is highly dependent on direction of approach of incident waves, on polarization of incident waves, and on mode admittances.

Figure 2:
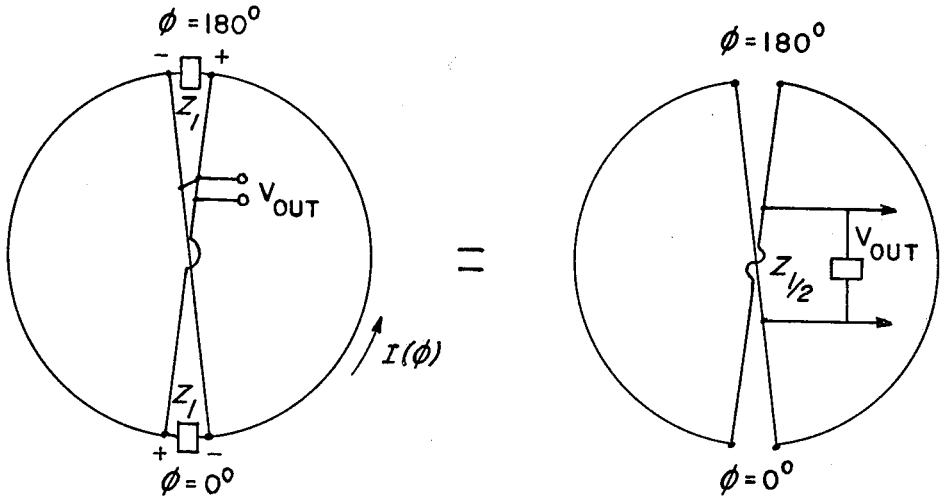
FIG. 2 is a diagrammatical representation of a single turn loop antenna having an inserted impedance Z, of the same value as the load impedance and being cross-connected.
Figure 3:
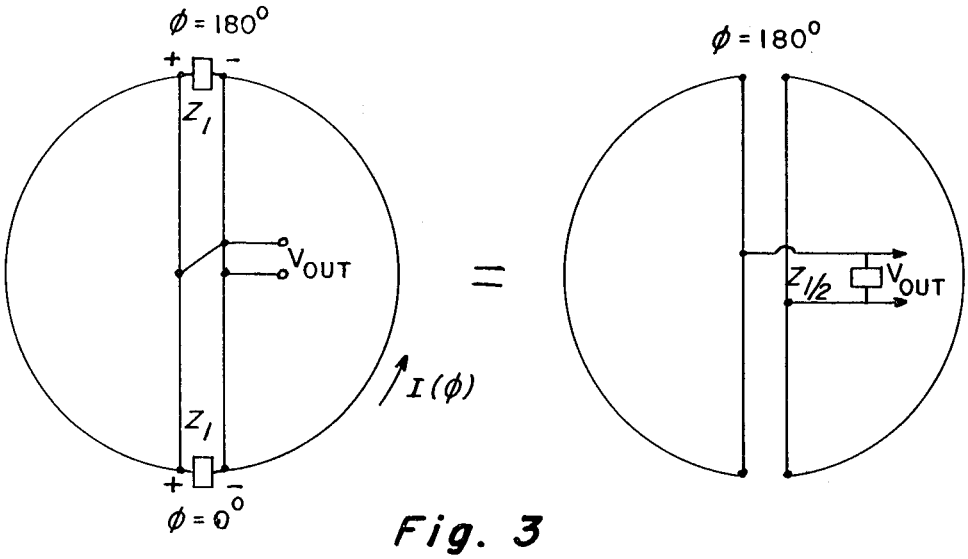
FIG. 3 is a diagrammatical representation of a single turn loop antenna having an inserted impedance Z, of the same value as the load impedance and parallel-connected.

The use of inserted impedances at other points in the loop leads to some interesting and useful results. For example, consider an inserted impedance at $\phi$=180° of the same value as the load impedance at $\phi$ = 0°. As shown in FIGS. 2 and 3 respectively, these two impedances are cross-connected and parallel-connected. When the solution is carried out as previously mentioned for inserted impedances, the results for the voltage output are as follows:

Cross-Connected $$V_{out} = j\frac{S}{2}\frac{\beta_o c\sin\theta_o E_N e^{j\alpha_1}}{Z_o/Z_l+2} \qquad (48)$$

Parallel-Connected $$V_{out} = \frac{S}{2} \frac{[\cos\phi_o E_N e^{j\alpha_1} + \sin\phi_o \cos\theta_o E_p e^{j\alpha_2}]}{Z_1/Z_l + 2} \quad (49)$$

Comparison of these equations with Eq.(47) shows that the zero and unity mode responses have now been isolated, the cross-connection showing response for only the zero mode, the parallel-connection showing response for only the unity mode. In effect, the use of these forcing connections separates the response into even modes or odd modes. Obviously, these cases are only a few of the many possible multiple impedance configurations which can be used to tailor the response to combinations of various modes, depending upon the desirability of certain polarization and/or impedance properties.

Finally, the effect of placing an open at any point of the loop can be easily ascertained by allowing the load admittance at that point to become zero. For example, placing an open at $\phi$=180° results in the following voltage equation:

$$V_l = jS \frac{(\beta_o c \sin\theta_o - j\cos\phi_o) E_N e^{j\alpha_1} - j\sin\phi_o \cos\theta_o E_p e^{j\alpha_2}}{\frac{Z_o + Z_1}{Z_l} + 4} \quad (50)$$

Comparison of Eq.(50) with Eq.(47) shows that an open at 180° removes the dependence of the response on the zero and unity mode admittances in the numerator. Again, obviously, an open or opens at other points can modify the polarization and admittance response of modes radically. Note also that the denominator can be altered so as to achieve various ratios and mode impedances to load impedance, particularly useful for resonance effects.

The results developed can now be extended to a geometry of multiple-turn series-connected loops.

MULTIPLE-TURN SERIES-CONNECTED LOOPS

Figure 4:
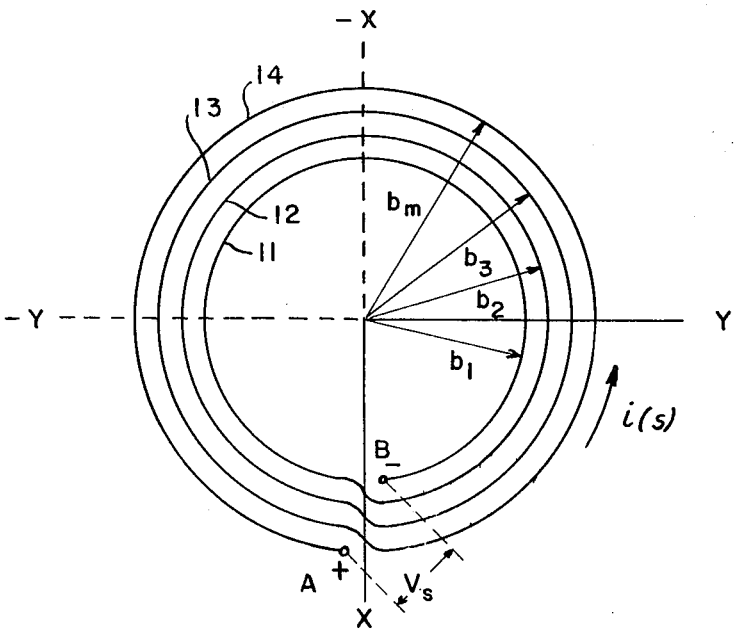
FIG. 4 is a pictorial representation of the geometry of a multi-turn, series-connected loop antenna.

The geometry of a multiple-turn series-connected loop formed of planar concentric turns is shown in FIG. 4. While only four turns 11–14 are shown, any number of turns can be used, and an open, or lumped impedance, can be inserted in one or more turns.

Figure 5:
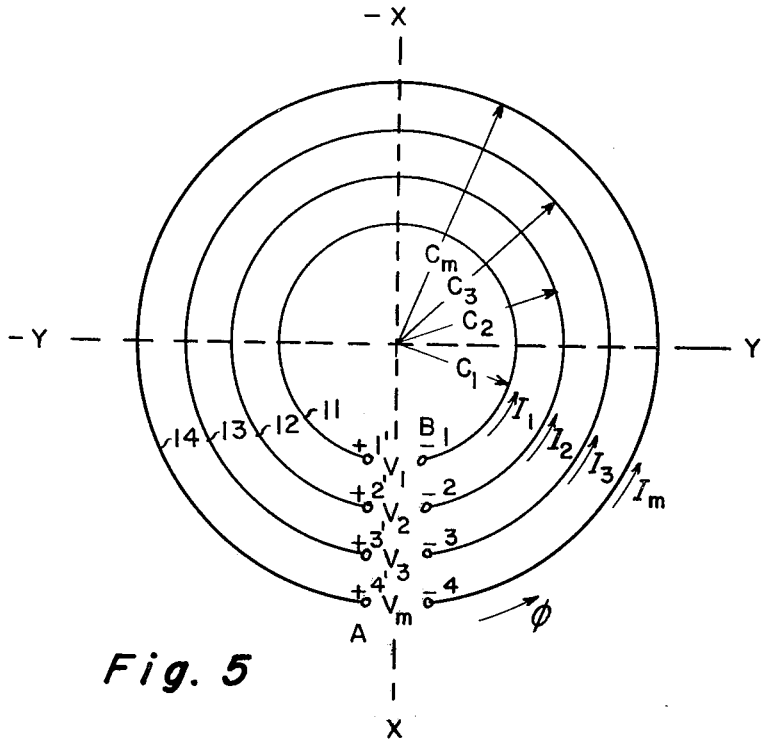
FIG. 5 is a schematic equivalent circuit for the multi-turn loop of FIG. 4 in the X—Y plane.

The loop lies in the X—Y plane. Due to the incidence of a plane wave on the turns, a voltage is developed across a load placed across terminals A—B. The polarity shown is a consequence of an assumed CCW current, $i(s)$. The radii shown are to the center of each conductor. Assuming closely spaced turns, the interconnection length between turns can be neglected. Each turn is treated as an individual loop to which the previously developed single-turn theory applies. Because of the polarities shown, the eventual solution of the input current, $i(s)$, in terms of $V_s$, will demand that that input impedance to the overall loop be the negative ratio of $V_s/i(o)$. This is the same condition that appeared for a single-turn loop (see Eq.39). The following assumptions and conditions will also be postulated:

1. An equivalent circuit is shown in FIG. 5. Signal voltages with the same polarity as in FIG. 4 will be assumed to exist across terminals 1-1', 2-2', . . . m-m'. A CCW Fourier series current is assumed to exist on each turn. The overall signal voltage will have the same polarity as each turn voltage.
2. The electric field equivalent to each turn signal voltage will be described by a delta function type, $V_p\delta(\phi)/_c$, where $V_p$ is any turn signal voltage and c is the turn radius to its outer edge. Since the electric field is a delta function sink, it enters the boundary equation as a negative.
3. The current coefficients in each of the turn Fourier series represent the true current at every point on every turn except at the beginning and end of each turn. The only continuous Fourier series for current is one that is periodic over all the turns. The postulation of individual turn Fourier series, in effect, introduces current discontinuities at the interconnections between turns. Hence, a correct solution will require the derivation of relations between an overall continuous Fourier series and the discontinuous turn Fourier series at each interconnection point.
4. Since there are as many unknown signal voltages as there are turns, $m$ equations are needed for the solution. The relations in (3) above will yield ($m$−1) equations. The mth relation is then the voltage circuital relation, $$\sum_{p=1}^{m} V_p = V_s.$$

5. The ($m$−1) equations of each interconnection (discontinuity) are postulated by the mean value theorem by stating that the value of the overall Fourier series at each discontinuity is equal to one-half the sum of the turn Fourier series current immediately before this point and the turn Fourier series current immediately after this point.
6. As in the single-turn loop, the input impedance to the multiple-turn loop will appear in the solution. This impedance is the series impedance of all turns. In addition, there is capacitive coupling between turns which represents continuously distributed leakage paths across turns. As complicated as the solution is presently, the inclusion of distributed capacity effects would probably add so much more complexity that a viable solution would become practically impossible. Fortunately, experience has shown that the capacity between pairs of turns is sufficiently small so that each can be closely approximated by a lumped capacity across each pair. Also, the calculation of each capacity yields results confirmed by experiment when such calculation is based on the open-wire-pair transmission line equation:

$$C = \frac{\pi\epsilon_o}{\cosh^{-1}\frac{s}{d}} \text{ farads/meter} \quad (51)$$

where $d$ = diameter of wire conductor
$s$ = separation between wires, center-to-center This capacity is sufficiently small that it can be neglected except in the vicinity of parallel resonance.

The procedure that will be followed to obtain an overall solution will be the following three steps:

1. Derive the coupled equations in terms of the turn Fourier series currents, turn voltages, and the external incident electric fields.
2. Derive the relations between turn Fourier series currents and overall Fourier series current, particularly at the interconnection points.
3. Apply the results of the first step to the $(m-1)$ equations obtained in the second step and solve for the signal voltage in terms of incident electric fields. The voltage circuital relation will provide the $m$th equation needed in this step.

STEP 1—COUPLED EQUATIONS

The boundary condition equation for each turn is given by Eq.(33):

$$\frac{-V_p}{c}\delta(\phi) = -E^i - \Sigma E_{\phi_p}{}^{ext} + Z_p{}^i I_p(\phi) \quad p=1\ldots m \tag{33}$$

The terms have the same definition as in Eq.(33) but now the external field includes plane wave incident electric fields and the $E_\phi{}^M$ field from all the other turns. This last field is the mutually coupled field.

The self-induced field, $E_\phi{}^I$, is given by Eq.(13):

$$c_p E_{\phi_p}{}^I = -\frac{1}{2\pi} a_{op} Z_{opp} - \frac{1}{\pi}\sum_{k=1}^{\alpha} [a_{kp}\cos k\phi + b_{kp}\sin k\phi] Z_{kpp} = 1\ldots m \tag{13}$$

The double subscript, pp, refers to the mode self impedance of the mode itself. The mutually coupled field, $E_\phi{}^M$, has the same form as the self-field:

$$c_p E_{\phi_p}{}^M = -\frac{1}{2\pi} a_{oq} Z_{opq} - \frac{1}{\pi}\sum_{k=1}^{\alpha} [a_{kq}\cos k\phi + b_{kq}\sin k\phi] Z_{kpq} \quad \begin{matrix} p=1\ldots m \\ q\neq p \end{matrix} \tag{52}$$

The $q$ subscript refers to the turn whose field is coupled to the p turn. Hence, $Z_{opq}$ and $Z_{kpq}$ are mutual mode impedances. Eqs.(8) and (10) define $Z_{opp}$ and $Z_{kpp}$. $Z_{opq}$ and $Z_{kpq}$ have the same forms as Eqs.(8) and (10) respectively with the exception that the Bessel-Hankel product enters as $\hat{J}_n(\beta o b_q)\hat{H}_n(\beta o b_p)$ (or the derivatives) rather than $\hat{J}_n(\beta o b_p)\hat{H}_n(\beta o c_p)$ as in the self-impedances. This change in the Bessel-Hankel product arguments of $c_p$ to $b_p$ is due to the fact that mutual impedance is reciprocal. Hence, the boundary condition of tangential electric field must be taken at the center of the wire conductor rather than at the outer edge in order for reciprocity to hold. For thin wires, the effect of this formulation is negligible on overall accuracy, Eq.(52) and Eq.(13) can be expressed as a single equation of the form of Eq.( 52) by merely allowing $q$ to equal $p$. Eq.(33) can now be written as:

$$-V_p\delta(\phi) = \sum_{q=1}^{m}\left\{\frac{1}{2\pi} a_{oq} Z_{opq} + \frac{1}{\pi}\sum_{k=1}^{\infty}[a_{kq}\cos k\phi + b_{kq}\sin k\phi] Z_{kpq}\right\}$$
$$+c_p\left\{a_{op} + \sum_{k=1}^{\infty}[a_{kp}\cos k\phi + b_{kp}\sin k\phi]\right\} Z_p{}^i - c_p \sum_{p=1\ldots m} E_{\phi_p}{}^{ext.inc.} \tag{53}$$

The last term on the right side now consists of only the external electric fields incident on the loop. Now again, using orthogonality relations and integrating as before for the single-turn loop and incorporating the internal impedance with the self-impedances in each turn:

$$-V_p = \left[\sum_{q=1}^{m} a_{kq} Z_{kpq}\right] - c_p \int_o^{2\pi} \cos k\phi(\Sigma E_{\phi_p}{}^{ext.inc.})\, d\phi \quad \begin{matrix} p=1\ldots m \\ k=0\ldots\infty \end{matrix} \tag{54}$$

$$0 = \left[\sum_{q=1}^{m} b_{kq} Z_{kpq}\right] - c_p \int_o^{2\pi} \sin k\phi(E_{\phi_p}{}^{ext.inc.})\, d\phi \quad \begin{matrix} p=1\ldots m \\ k=1\ldots\infty \end{matrix} \tag{55}$$

Each of the above equations can be expressed in matrix form as follows:

$$[a_{kq}] = [Z_{kpq}]^{-1} \times [-V_p + c_p \int_o^{2\pi} \cos k\phi(\Sigma E_{\phi_p}{}^{ext.inc.})d\phi] \quad \begin{matrix} p,q=1\ldots m \\ k=0\ldots\infty \end{matrix} \tag{56}$$

$$[b_{kq}] = [Z_{kpq}]^{-1} \times c_p\left[\int_o^{2\pi} \sin k\phi(\Sigma E_{\phi_p}{}^{ext.inc.})d\phi\right] \quad \begin{matrix} p,q=1\ldots m \\ k=1\ldots\infty \end{matrix} \tag{57}$$

where $$[a_{kq}] = \begin{bmatrix} a_{k1} \\ a_{k2} \\ \vdots \\ a_{km} \end{bmatrix} \quad k=0\ldots\infty \qquad [b_{kq}] = \begin{bmatrix} b_{k1} \\ b_{k2} \\ \vdots \\ b_{km} \end{bmatrix} \quad k=1\ldots\infty \tag{58}$$

$$[Z_{kpq}]^{-1} = \begin{bmatrix} Z_{k11} & Z_{k12} \cdots Z_{k1m} \\ Z_{k21} & Z_{k22} \cdots Z_{k2m} \\ \vdots & \vdots \\ Z_{km1} & Z_{kmm} \end{bmatrix} = [M_{kpq}] = \begin{bmatrix} M_{k11} & M_{k12} & M_{k1m} \\ M_{k21} & & M_{k2m} \\ & & \\ M_{km1} & & M_{kmm} \end{bmatrix}_{k=0\ldots\infty} \tag{59}$$

$$\left[-V_p+c_p \int_o^{2\pi} \cos k\phi(\Sigma E_{\phi_p}{}^{ext.inc.})d\phi\right] = \begin{bmatrix} -V_1+c_1 & \int_o^{2\pi} \cos k\phi(\Sigma E_{\phi_p}{}^{ext.inc.})d\phi \\ & \vdots \\ -V_m+c_m & \int_o^{2\pi} \cos k\phi(\Sigma E_{\phi_p}{}^{ext.inc.})d\phi \end{bmatrix}_{k=0\ldots\infty} \tag{60}$$

The matrix for the last term on the right side of Eq.(57) is obvious. Note that $Z_{kpq}$ and $M_{kqp}$ are both symmetrical relative to $p,q$. After performing the inverse matrix operation, Eqs.(56) and (57) yield a solution for each mode current on each turn in terms of known self and mutual admittances, unknown turn signal voltages, and external incident electric fields. The form of each solution is as follows:

$$a_{o1}=M_{o11}\left[-V_1+c_1 \int_o^{2\pi} (\Sigma E_{\phi_1}{}^{ext.inc.})d\phi\right]+M_{o12}\left[-V_2+c_2 \int_o^{2\pi} (\Sigma E_{\phi_2}{}^{ext.inc.})d\phi\right]\cdots$$
$$\cdots M_{o1m}\left[-V_m+c_m \int_o^{2\pi} (\Sigma E_{\phi_m}{}^{ext.inc.})d\phi\right]$$
$$\vdots$$
$$a_{om}=M_{om1}\left[-V_1+c_1 \int_o^{2\pi} (\Sigma E_{\phi_1}{}^{ext.inc.})d\phi\right]+M_{om2}\left[-V_2+c_2 \int_o^{2\pi} (\Sigma E_{\phi_2}{}^{ext.inc.})d\phi\right]\cdots$$
$$\cdots M_{omm}\left[-V_m+\epsilon_m \int_o^{2\pi} (\Sigma E_{\phi_m}{}^{ext.inc.})d\phi\right] \tag{61}$$

The equations for $a_{kl}$ -----$a_{km}$ and $b_{kl}$ to $b_{km}$ are obvious and easily written. The equations for $a_{kq}$ and $b_{kq}$ represent two infinite sets of m equations.

An extension to the above results consists of inserting lumped impedances in one or more turns. Because the general case of any arbitrary number inserted at any position in one or more terms results in an impractical solution from the viewpoint of complexity and inadequate guidelines for interpretation of the results, the inserted impedances will be limited to one impedance at $\phi$=180° in one or more turns. The reason for an utility of this extension will be shown subsequently. As shown previously, the boundary condition equation (53) for a turn in which an impedance is inserted at $\phi$=180° must be modified in its left side by adding the term: $-V_{p\,180°}\ \delta(\phi-180°)$. Then Eq.(54) becomes $-(V_p+(-1)^k V_{p\,180°})$. (Note: cosk 180°=$(-1)^k$), Eq.(55) remains as is. The general form of the turn current equations can now be expressed as follows:

$$I_q(\phi) = \sum_{k=o}^{\infty} \sum_{p=1}^{m} \left\{ M_{kqp}\left[-V_p-\sigma_p V_{p\,180°}+c_p \int_o^{2\pi} (\Sigma E_{\phi}{}^{ext.inc.})\cos k\phi' d\phi'\right]\cos k\phi + M_{kqp}\left[c_p \int_o^{2\pi} (\Sigma E_{\phi_p}{}^{ext.inc.})\sin k\phi' d\phi'\right]\sin k\phi \right\}_{q=1\ldots m} \tag{62}$$

where $\sigma_p$ = zero for no inserted impedance $\sigma_p = (-1)^k$ for an impedance at 180°

Note that $\phi'$ is now used within the integrals instead of $\phi$ because the integration is to be performed independently of any value assigned to $\phi$ in $I_q(\phi)$. Now the $V_{p\,180°}$ voltages must be eliminated. To do so, allow $\phi$ to be 180° in each turn which has an inserted impedance. Then since $I_q(180°)$ is equal to $(V_{q180°})$ $(Y_{q180°})$, the left side of Eq. (62) becomes $V_{1180°}Y_{q180°}$ and Eq. (62) represents a number of simultaneous equations, the number being equivalent to the number of turns each of which has an impedance at $\phi$= 180°. These simultaneous equations can be solved for all the $V_{p180°}$ voltages which can then be eliminated from Eq. (62). We can now go to Step 2.

Step 2. — Relations Between Turn Fourier Series Currents And Overall Fourier Series Currents (In Effect, Current Continuity Conditions)

The overall Fourier series current is expressed as follows:

$$i(s)=a_o+\sum_{y=1}^{\infty}\left[a_y\cos 2\pi y\frac{s}{L}+b_y\sin 2\pi y\frac{s}{L}\right] \quad o \leq s \leq L \tag{63}$$

-continued $$\text{where } L = 2\pi \sum_{1}^{m} b_m$$

$b_m$= radius to center of $m$ wire conductor

This function can be broken into a number of intervals which correspond to the number of turns. Thus, for turn 1 — turn $m$:

$$i_1(s)=a_o+\sum_{y=1}^{\infty}\left[a_y\cos 2\pi y\frac{s}{L}+b_y\sin 2\pi y\frac{s}{L}\right] \quad o\leq s\leq 2\pi b_1 \tag{64}$$

$$i_2(s)=a_o+\sum_{y=1}^{\infty}\left[a_y\cos 2\pi y\left(\frac{2\pi b_1+s}{L}\right)+b_y\sin 2\pi y\left(\frac{2\pi b_1+s}{L}\right)\right] \quad o\leq s\leq 2\pi b_2 \tag{65}$$

$$\vdots$$

$$i_m(s)=a_o+\sum_{y=1}^{\infty}\left[a_y\cos 2\pi y\left(\frac{2\pi\sum_{1}^{m-1} b_m+s}{L}\right)+b_y\sin 2\pi y\left(\frac{2\pi\sum_{1}^{m-1} b_m+s}{L}\right)\right] \quad o\leq s\leq 2\pi b_m \tag{66}$$

The Fourier series for each turn corresponding to each of the above equations are:

$$I_1(s)=a_{o1}+\sum_{k=1}^{\infty}\left[a_{k1}\cos\frac{ks}{b_1}+b_{k1}\sin\frac{ks}{b_1}\right] \quad o<s<2\pi b_1 \tag{67}$$

$$I_2(s)=a_{o2}+\sum_{k=1}^{\infty}\left[a_{k2}\cos\frac{ks}{b_2}+b_{k2}\sin\frac{ks}{b_2}\right] \quad o<s<2\pi b_2 \tag{68}$$

$$I_m(s)=a_{om}+\sum_{k=1}^{\infty}\left[a_{km}\cos\frac{ks}{b_m}+b_{km}\sin\frac{ks}{b_m}\right] \quad o<s<2\pi b_m \tag{69}$$

In Eq.(63), the range of $s$ is over all turns. In Eqs.(6-4)–(69), the range of $s$ is over an individual turn. Also, since $s=b\phi$, the variable in Eqs.(67)–(69) can be expressed as $k\phi$ rather than $ks/b$. The limits then change to $o<\phi<2\pi$. Now using the mean value theorem:

$$i_1(2\pi b_1)=\frac{I_1(2\pi b_1-\epsilon)+I_2(o+\epsilon)}{2}=\frac{I_1(o)+I_2(o)}{2}=i(2\pi b_1) \tag{70}$$

$$i_2(2\pi b_2)=\frac{I_2(2\pi b_2-\epsilon)+I_3(o+\epsilon)}{2}=\frac{I_2(o)+I_3(o)}{2}=i(2\pi b_1+2\pi b_2) \tag{71}$$

$$\vdots$$

$$i_{m-1}(2\pi b_{m-1})=\frac{I_{m-1}(2\pi b_{m-1}-\epsilon)+I_m(o+\epsilon)}{2}=\frac{I_{m-1}(o)+I_m(o)}{2}=i\left(2\pi\sum_{1}^{m-1} b_m\right) \tag{72}$$

In the above equations, $\epsilon$ is considered to be vanishingly small. Note that there are $(m-1)$ equations above. The mth equation needed is the voltage circuital equation:

$$\sum_{p=1}^{m} V_p = V_s \tag{73}$$

It is now necessary to establish a relation between the value of the overall Fourier series at a discontinuity and the values of the overall Fourier series at other points. Since there is a direct geometrical relation between the overall Fourier series points and the individual turn Fourier series points, the values for the latter points can then be substituted for the values at the points of the overall Fourier series. One preliminary step will first be carried out. This is the requirement to express the constant term, $a_o$, in terms of the individual turn current coefficients. To do so, the corresponding equations for each turn are equated and integrated directly. Then the left sides of each equation are summed and then the right sides. The result is that all the summation terms cancel leaving:

$$a_o=\sum_{1}^{m} R_m a_{om} \qquad \text{where } R_m=\frac{b_m}{\sum_{m=1}^{m} b_m} \tag{74}$$

Now to find the value of $i(s)$ at any discontinuity in terms of values of $i(s)$ at other points, one must first find the value of $i(s)$ at a point $^{L}/2$ or $^{-L}/2$ from the discontinuity, the plus or minus sign depending upon whether the discontinuity lies less than or more than halfway from the beginning of the turns. In either case, reference to Eq.(63) shows that the value of $i(s \pm L/2)$ yields the original $i(s)$ individual terms, but with the even $y$ modes positive and with the odd $y$ modes negative. Next, take pairs of points around the discontinuity, each pair having the same equal numerical increment and decrement. Cover the total length, L, with these pairs, using the precaution that no point lies at any other discontinuity. Now sum the contributions of all of these points. The final result will be an equation in which the value of $i(s)$ at the discontinuity is expressed in terms of the values of $i(s)$ at the $(s \pm L/2)$ point and at all the pairs of points, with some high-order negligible terms which can be neglected to a close approximation. As an example of the method, let us find the value of $i(o)$. Divide L arbitrarily into twelve parts. The following table can be constructed;

| $i(s_p)$ | $s_p$ | $\cos 2\pi y(s_{p/L})$ | $\sin 2\pi y(s_{p/L})$ |
|---|---|---|---|
| $i(s_1)$ | $-L_{12}=11L/_{12}$ | cos 330°y | sin 330°y |
| $i(s_2)$ | L/12 | cos 30° y | sin 30°y |
| $i(s_3)$ | $-2L_{12}=10L/_{12}$ | cos 300°y | sin 300°y |
| $i(s_4)$ | $2L/_{12}$ | cos 60°y | sin 60°y |
| $i(s_5)$ | $-3L_{12}=9L/_{12}$ | cos 270°y | sin 270°y |
| $i(s_6)$ | $3L/_{12}$ | cos 90°y | sin 90°y |
| $i(s_7)$ | $-4L_{12}=8L/_{12}$ | cos 240°y | sin 240°y |
| $i(s_8)$ | $4L/_{12}$ | cos 120°y | sin 120°y |
| $i(s_9)$ | $-5L_{12}=7L/_{12}$ | cos 210°y | sin 210°y |
| $i(s_{10})$ | $5L/_{12}$ | cos 150°y | sin 150°y |
| $i(s_{11})$ | $-6L_{12}=6L/_{12}$ | cos 180°y | sin 180°y |

Taking sums of each mode from the above values of $i(s_p)$, the final equation becomes:

$$\sum_{p=1}^{11} i(s_p) = 12 \sum_{y=0,12,24-}^{\infty} a_y - \sum_{y=0,1,2,3-}^{\infty} a_y \qquad (75)$$

From Eq.(63), it is obvious that the last term on the right side of Eq.(75) is $i(o)$. Hence:

$$i(o) = 12\, a_o + 12 \sum_{y=12,24,-}^{\infty} a_y - \sum_{p=1,2,-}^{11} i(s_p) \qquad (76)$$

If modes $a_{12}$, $a_{24}$, etc. can be considered negligible, then:

$$i(o) \approx 12\, a_o - \sum_{p=1,2,-}^{11} i(s_p) \qquad (77)$$

Since $a_o$ can be expressed in terms of $a_{om}$ using Eq.(74), and $i(s_p)$ can e expressed in terms of the turn Fourier series coefficients by corresponding the geometrical point, $s_p$, on the overall turns configuration to the related geometrical point on each turn, then $i(o)$ can be expressed completely in terms of the turn coefficients. The same procedure for any other point of discontinuity yields the same resultant equation. The general equation for any such point, showing the form of the negligible high-order terms is:

$$i(s) = 12\, a_o - \sum_{p=1}^{11} i(s_p) + 12 \sum_{y=12,24}^{\infty} \left[ a_y \cos 2\pi y \frac{s}{L} + b_y \sin 2\pi y \frac{s}{L} \right] \qquad (78)$$

The high-order negligible terms are the last ones on the right side.

If one uses finer subdivision such as L=24 parts, the factor $a_{12}$ can be eliminated. The resultant equation would be:

$$i(s) = 24\, a_o - \sum_{p=1,2,-}^{23} i(s_p) + 24 \sum_{y=24,48,-}^{\infty} \left[ a_y \cos 2\pi y \frac{s}{L} + b_y \sin 2\pi y \frac{s}{L} \right] \qquad (79)$$

where sub-divisions 1–23 are in 24ths. Extension to higher numbers of parts should be readily apparent.

It might be instructive to show how the values of $i(s_p)$ are converted to values of I(s). Let us assume two turns, and L=12 parts. We will take two of the eleven points required, one at $^{-L}/$12 and one at $^{L}/$12. The following table is constructed:

For $i(o)$

| $i(s_p)$ | $s_p$ | $s$ | $ks/b_1$(for Turn 1) | i $ks/b_2$(for Turn 2) |
|---|---|---|---|---|
| $i(s_1)$ | $-L/12=11L/12$ | $[22\pi(b_1+b_2)/12-2\pi b_1]$ | ——— | $k/b_2 \left[\frac{22\pi}{12}(b_1+b_2)-2\pi b_1\right] = k(2\pi-30°/R_2$ |
| $i(s_2)$ | $L/12$ | $2\pi(b_1+b_2)/12$ | $k30° \frac{(b_1+b_2)}{b_1} = k30°/R_1$ | ——— |

As shown above, point $s_1$ lies on Turn 2, point $s_2$ lies on Turn 1. All the other points can be obtained in the same fashion. The extension to any number of turns, any number of points, and any number of discontinuities, is obvious. Now, the final step is to substitute the tabulated results into the turn Eqs. (67), (68), and then to substitute these results plus Eq.(74) into Eq.(77). The load current, $i(o)$, is now expressed wholly in terms of the individual turn currents. Thus, for two turns and L=12 parts the result is:

$$i(o) \approx [12R_1a_{01}+12R_2a_{02}-5a_{01}-6a_{02}] - \sum_{k=1}^{\infty} \Big\{ a_{k1}[\cos k30°/R_1+\cos k60°/R_1+\cos k90°/R_1 + \cos k120°/R_1+\cos k150°/R_1] + b_{k1}[\sin k30°/R_1+\sin k60°/R_1+\sin k90°/R_1$$

-continued $$+\sin k120°/R_1+\sin k150°/R_1]$$

$$+a_{k2}[\cos k30°/R_2+\cos k60°/R_2+\cos k90°/R_2$$

$$+\cos k120°/R_2+\cos k150°/R_2+\cos k180°/R_2]$$

$$\left.\begin{aligned}-b_{k2}[&\sin k30°/R_2+\sin k60°/R_2+\sin k90°/R_2\\&+\sin k120°/R_2+\sin k150°/R_2+\sin k180°/R_2]\end{aligned}\right\} \quad (80)$$

For the current at the interconnection of Turn 1 to Turn 2, the equation for $i(2\pi b_1)$ is identical to Eq.(80) except that the algebraic signs in front of the $b_{k1}$ and $b_{k2}$ coefficients reverse. Thus, if the $b$k's were zero, the currents at $s=0$ and $s=2\pi b_1$ would be identical. This is not precisely accurate, even though experiment has shown that it is close to the true condition. That is a very close approximation rather than an absolute accuracy can be ascribed to the facts that the high-order modes, twelfth, twenty-fourth, etc. were taken as negligible, and the interconnection length has been neglected.

I have developed the relations for three and four turns. However, they will not be shown since the procedures to derive them should be readily apparent from the foregoing analysis. The results for any number of turns are now substituted into the mean value theorem equations, Eqs.(70) to (72), to yield the $(m-1)$ interconnection equations (current continuity equations). Also note that the equation for $i(o)$, the load current, will be used to obtain the overall input impedance.

Step. 3. — Signal Voltage And Input Impedance Using Results Of Steps 1 and 2

All the information needed to fulfill this step is now available. The sequence by which the total solution is obtained is as follows:

a. The coefficients of $\cos k\phi$ and $\sin k\phi$ in Eq.(62) are the $a_{kq}$ and $b_{kq}$ mode currents. Hence, for any particularly selected multi-turn loop geometry and inserted impedances, the individual mode current is formulated from Eq.(62).

b. The individual mode current values are substituted into the $(m-1)$ interconnection equations and in the load current, $i(o)$, equation. For the interconnection equations, collect the coefficients of each $V_p$ and $V_{p180°}$ and place these factors on the left side of each equation. All the external incident field factors are placed on the right side of each equation.

c. Using the equations for the mode impedance of a single turn, Eqs. (8) and (10), and the same equations as modified for mutually coupled impedances, the values of the inverse mode impedance matrix, Eq.(59), are calculated and each $M_{kqp}$ value obtained.

d. The $M_{kqp}$ values are substituted into the $(m-1)$ interconnection equations and in the $i(o)$ equation. The resulting equations will now have known coefficients for the $V_p$'s and $V_{p180°}$'s.

e. Eq.(62) is used to formulate an equation for each turn in which an open or impedance is inserted at $\phi=180°$. The left side of each equation is $V_{q180°}Y_{q180°}$.

f. The equations of (e) are solved simultaneously for each $V_q$ in terms of $V_p$'s $M_{kqp}$'s and external incident field factors. The values of the $m_{kqp}$'s are substituted in each equation for $V_q$.

g. The values for each $V_q$ are substituted into the $(m-1)$ interconnection equations and in the $i(o)$ equation.

h. The $(m-1)$ interconnection equations are solved from the previous step (g) simultaneously with the voltage circuital equation, Eq.(73), to obtain each $V_p$ in terms of the signal voltage, $V_s$.

i. Each $V_p$ is substituted in terms of $V_s$ in the $i(o)$ equation. Now, by analogy with the single-turn loop Eq.(39), the input admittance to the multi-turn loop with all external incident fields zero is the negative ratio of $V_s/i(o)$.

j. The input admittance from previous step (i) is substituted in the i(o) equation. $V_sY_l$ is substituted for i(o) itself where $Y_l$ is the load admittance.

k. $V_s$ is solved for in terms of external incident fields, input admittance, and load admittance. The overall solution is now complete, even to the extent of obtaining numerical values for each and every voltage and for each mode current.

PRACTICAL USE OF MULTI-TURN SERIES-CONNECTED LOOP THEORY

The theory of the multi-turn series-connected loop presented has the intrinsic capability of utilization for a transmitting antenna in addition to that for a receiving antenna at any frequency compatible with physical limitations. Thus, it can be advantageously and effectively used as a design tool for a miniaturized antenna in terms of electrical size, as well as for large electrical size antennas. In addition to the planar configuration of series-connected turns, the theory can be easily modified to incorporate; a cylindrical type of turn configuration, a conic type of geometry, a number of impedances inserted at points other than at $\phi=180°$, and finally turns reversed in direction and fractional turns. In each of these modifications, the criteria for use is to achieve desired input impedance levels, or broad-band frequency response, or directionality, or radiation efficiency, or desired field pattern coverages. As a matter of fact, the use of alternate reversed turns leads essentially to a close approximation to the configuration designated as the double spiral antenna, a known broad-band type. The one requirement which must be fulfilled in every geometry is that of close turn spacing.

Obviously, the complexity of the equations involved in the solution negates the ability to synthesize an antenna with desired characteristics by the use of inspection of and deduction from the equations. Such antennas can still be designed, however, by programming the equations on a high-speed computer, using parameter variation to develop curves of impedance characteristics versus frequency, to develop field patterns, to develop responses to incoming fields, and to calculate the effect of varying inserted impedances on all the foregoing. Some of the more difficult types of terms to calculate which enter into the impedance and field equations are the spherical Bessel and Hankel functions. By the use of backward recursion, calculations of these functions for any argument, real or complex, has been achieved. All other terms in these equations are straightforward including the associated legendre polynomials which are merely trigonometric series functions. If a complete computer program were developed, it would have the virtue of totally mechanizing and rapidly achieving any antenna design of multi-turn loops for almost any desired characteristic.

Even in the absence of the new availability of such a program, however, one can still utilize the theory developed profitably and easily by confining electrical size of the turns in each multiturn loop to miniaturized values, defined herein as a turn diameter less than about 0.08λ or a circumference of less than about 0.25λ. Under this stipulation, the following assumption and conditions are postulated:

1. For miniaturized turns, only the zero and unity mode self and mutual impedances and currents are significant. Higher order modes can be neglected to a very close approximation.

2. The resistive components of the impedance are very small relative to the reactance portion. Hence, only the reactance will be used.

3. Eqs. (8) and (10) for the mode self-impedances and their modifications for the mutual impedances can now be closely approximated by reactances as follows:

$$X_{opp} = 240\pi^2 \frac{b_p}{\lambda} \log_e 1.08266 \frac{b_p}{a} \quad (81)$$

$$X_{opq} = 240\pi^2 \frac{b_p}{\lambda} \log_e 1.08266 \frac{b_p}{b_q - b_p} \quad (82)$$

$$X_{lpq} = -30 \frac{\lambda}{b_p + a} \log_e 1.08266 \frac{b_p}{a} \quad (83)$$

$$X_{lpq} = -30 \frac{\lambda}{b_q} \log_e 1.08266 \frac{b_p}{b_q - b_p} \quad (84)$$

4. For any turn configuration, a ratio of $b_p/a$, the turn radius to the wire conductor radius must be assigned. For thin wires, this ratio should lie in the range of 50 to 200.

5. The $R_m$ ratios (see Eq. 74) for closely spaced turns must be assigned.

6. Under foregoing conditions (4) and (5), all zero mode impedances can be expressed as a known numerical ratio of each impedance normalized to a selected turn zero mode self-impedance. The same can be done for the unity mode impedances.

7. Before the sequence of solution in Step 3 previously given is followed, a value for the circumferential electrical length of one turn, $2\pi b/\lambda$, is assigned. Thus, the self-reactances for the zero and unity modes are immediately known.

All the information necessary to obtain numerical solutions is now available. As far as the external fields incident on the turns are concerned, the value previously obtained for a single-turn loop, Eq. (47), is used for each turn with proper regard exercised for the individual radius and mode admittance of each turn.

It is now necessary to explain the principle upon which the performance of the multi-turn series-connected loop, as an efficient miniaturized transmitting antenna, and as a sensitive receiving antenna, is based. Previous calculations and experience have shown that an electrically small complete single loop exhibits an input impedance consisting of a very small resistance in series with a very much larger inductive reactance. The resistance is always of the same order as the internal conductor loss resistance and even smaller the more miniaturized the size of the loop. The result is that the radiation efficiency, which is a measure of radiated power to total input power, is very small. Now a loop in which an open or capacitor is inserted at some point in the loop exhibits an input impedance again consisting of a small resistance, but now in series with a capacitive reactance. Now, however, the resistance is much larger than that of the complete loop mainly because it is due to the unity current mode while that of the complete loop is due to the zero mode. If a number of turns are now connected in series, with one or more turns having a capacitor or open at some point while the others are complete, it is obvious that a series resonant condition can occur. Actual calculations and experimental tests have verified that the reactance component of the input impedance to such a loop exhibits large capacitive reactance at some frequency which then reduces to zero at a higher frequency (series resonance), and then goes to infinite inductive reactance (parallel resonance). This is the usual type of resonance curves of an L-C circuit. The reactance then repeats this characteristic as the frequency is increased further. Thus, at series resonance, the impedance is a pure resistance. This resistance is not the sum of each turn resistance which represents radiated power, but rather the square of the turn resistance, because of all the bilateral coupling effects. The internal conductor loss resistance is directly proportional to the number of turns, and a gain in radiation efficiency is thus achieved. The radiation is a maximum since it arises from moving charges or current which is now also a maximum. Experimental tests have verified this gain in radiation efficiency. The frequency at which series resonance occurs can be varied by varying an inserted capacitor or capacitors, by using different number of turns, by varying the spacing between turns, and by varying the size of the turns.

Relative to the receiving antenna function, the result will be now presented for a signal voltage developed across a two-turn loop in terms of external incident fields: (Note-one turn has a small capacitor at $\phi$=180°).

$$V_s = -3.387 \frac{Z_l}{Z_{in} + Z_l} [F(\text{Ext. Incident Fields})] \quad (85)$$

For a single loop of the same physical size, the signal voltage was:

$$V_s = -1.005 \frac{Z_l}{Z_{in} + Z_l} [F(\text{Ext. Incident Fields})] \quad (86)$$

In Eq. (85), $Z_{in}$ is the input impedance to a two-turn loop. In Eq. (86), $Z_{in}$ is the input impedance to a single-turn loop. The function F on the right side of each equation is the same for each configuration. The open-circuit voltage for each occurs when $Z_l = \infty$. Hence:

$$\frac{V_{oc} \text{ two-turn}}{V_{oc} \text{ one-turn}} = \frac{3.387}{1.005} = 3.37 \quad (87)$$

In effect, the two-turn loop enhances the signal voltage by almost $n^2$ or $2^2$. This is the result of bilateral coupling. It is also based on the assumption that the impedance factor in both equations, which involves two different input impedances and load impedances, can be made equal which can usually be accomplished. The second and probably, most significant factor which enhances receiving sensitivity is the term in the denominator of Eq. (85), $(Z_{in}+Z_l)$. Since $Z_{in}$ can be varied by a single small capacitor in one turn so as to achieve an input reactance either capacitive or inductive or zero, then the signal voltage, $V_s$, can be maximized by resonating $Z_{in}$ with $Z_l$. If the load is a pure resistance, then $V_s$ can still be maximized by minimizing $Z_{in}$ to a small pure resistance. The solution for three and four turn loops has yielded an identical dependence on the impedances, but with a larger numerical multiplying factor which approximately follows $n^2$.

The designs for both a two-turn and three-turn loop have been calculated for use as a VHF TV miniaturized receiving antenna covering all the channels from 13 to 2(216 MHZ–54 MHZ). Both antennas are approximately 3¾ inches in diameter, and include a spacing between turns of about 1/16 inch. In both cases, a variable capacitor is inserted at $\phi$=180° in each of two turns. Both designs provide a highly sensitive tunable receiving antenna covering 216 MHZ continuously down to 54 MHZ. The minimum tuning capacities required are less than one micro-micro-farad. This value is difficult to achieve in practice in a variable condenser, presenting some practical objections.

Hence, another antenna was designed, both by calculation and experimentally, which did fulfill the required performance after being built. A description of it and the results achieved will be given in the next section. Before presenting it, a very important point must be emphasized. This is that a practical design for one range of frequencies can be used for either higher or lower frequency ranges by modifying the physical sizes and spacings by the ratio of the two frequency ranges, and by increasing tuning capacities used by the same ratio for lower frequency and decreasing for higher frequency. This is a direct result of the principle of electrodynamic similtude.

DESCRIPTION OF MINIATURIZED INDOOR VHF ANTENNA ALSO CAPABLE OF FM RECEPTION

Figure 7:
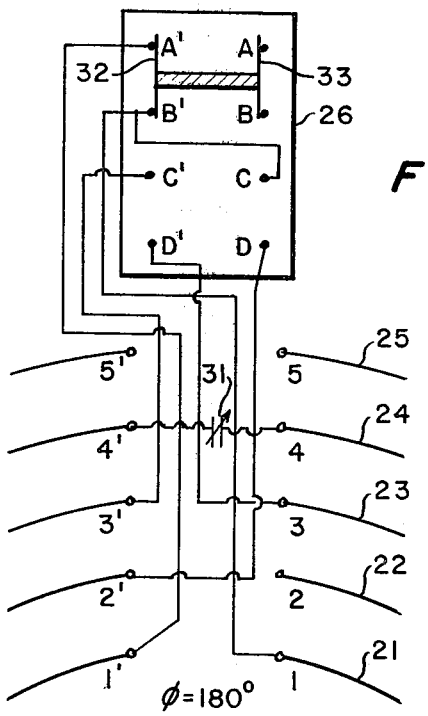
FIG. 7 is an enlarged fragmentary front elevational view of a switch interconnecting the several loops of a multi-turn loop antenna embodying the present invention.
Figure 6:
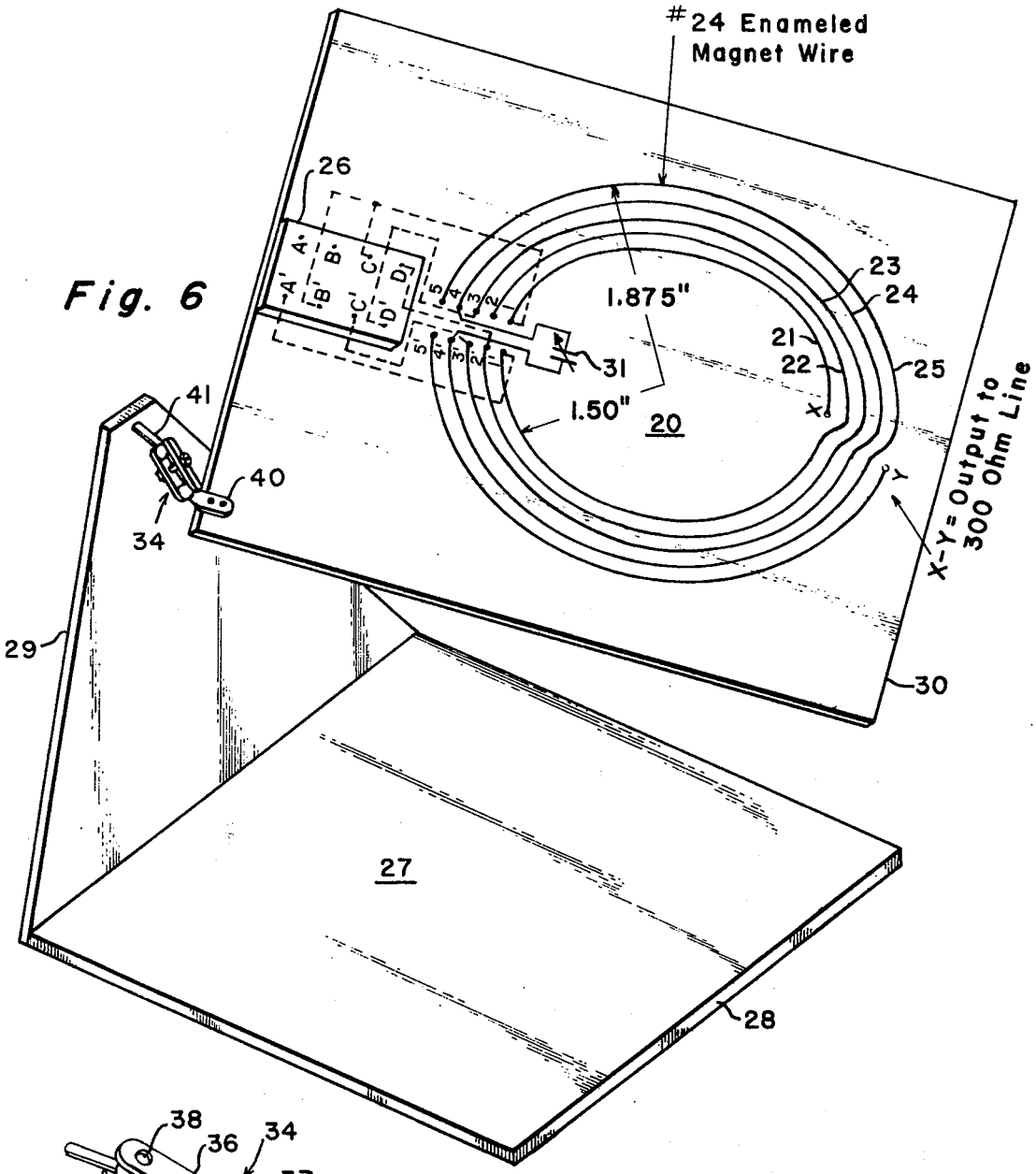
FIG. 6 is a perspective view of a multi-turn, series-connected loop antenna embodying the present invention.
Figure 8:
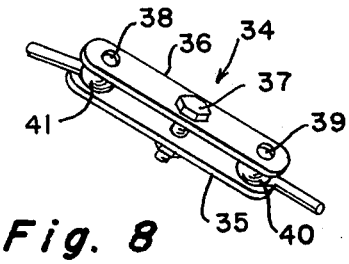
FIG. 8 is a perspective view of a universal joint suitable for use with the present invention.

In accordance with a preferred embodiment of the invention, there is provided a miniaturized multi-turn series-connected antenna capable of reception of signals from local television channels and channels about 35 miles distant. FIGS. 6–8 illustrate a physical embodiment of an antenna constructed in accordance with the principles of my invention. As shown in FIG. 7, the antenna 20 includes five series-connected loops 21-25 interconnected by means of slide switch connections of switch 26. As shown in FIG. 6, the antenna 20 is mounted for universal positioning by means of a conventional universal joint support 34 extending from a pedestal 27 comprising a base member 28 and vertically extending wall support 29. The cylindrical turns themselves are conventionally supported to a thin, lightweight insulative substrate 30, which also supports slide switch 26 and a tuning capacitor 31.

The antenna 20 is a five-turn series-connected loop. Tuning condenser 31 has a range of values from 1.7 to 20mmf. and is interconnected at $\phi$=180° in turn 24. Even better performance is achievable with a smaller condenser, an E. F. Johnson type V with values of 1.4 to 13mmf. The principles which permit the use of a single tuning condenser over the entire 216–54 MHZ range are the following:

1. The use of two or more series-connected, planar, concentric turns with an open or capacitor in one turn always leads to a series-resonant condition.

2. A complete turn is inductive. A turn with an open or capacitor in it is capacitive. The former decreases the frequency at which series resonance occurs. The latter increases the series-resonant frequency.

3. Given a number of turns, the ability to switch opens to shorts or vice-versa at particular points in one or more turns permits the capability of selecting frequency ranges over which a single tuning capacitor in one turn can tune for resonance.

Referring to FIG. 6, the slide switch connections are shown in dash lines. FIG. 7 shows these same electrical interconnections in solid lines. Tracing around the entire loop for position 1, starting at the X terminal, shows that turn 21 is completed through the A′ B′ terminals of switch 26 and the movable slide contact. Turns 22, 23 and 25 have opens at $\phi$=180°, that is, at the 2′-2, 3′-3 and 5′-5 connections of the loops. Across the $\phi$=180° position of turn 24, variable condenser 31 is connected. This position permits the ability to achieve maximum signal voltage in conjunction with the impedance into a TV receiving set over channels 13–7, the high VHF band.

If the slide switch is placed in position 2 with the slides 32 and 33 interconnecting terminals B′C′ and BC, the same loop tracing reveals that there is one complete turn (half of turn 21 and half of turn 23), one turn with an open at $\phi$=180°, turn 25, and turn 24 has the variable condenser interconnected between terminals 4′-4. This position is used to achieve maximum signal voltage for channels 6–4. A third position of switch 26, that is sliders 32 and 33 connecting contacts C′D′ and CD, respectively, provides two complete turns consisting of half of turn 21 and half of turn 22 as one of them, turn 23 as the other, turn 25 with an open at $\phi$=180°, and turn 24 with variable condenser 31 between contacts 4′-4. This position covers channels 5–2. While to some extent this last position is redundant, experience has shown that in certain cases it yields somewhat better response than that achieved by the second or middle position of switch 26.

To cover the FM range of 108–88 MHZ, a fourth position is utilized. This can be done with a 5 pole four position slide switch (not shown) rather than the 4 pole three position switch 26 shown. In the alternative, an auxiliary slide switch may be mounted to substrate 30. The loop configuration needed consists of two complete turns, two turns with opens at $\phi$=180°, and one turn with a variable condenser at $\phi$=180°.

The ability to rotate the antenna in two degrees of freedom and to translate allows one to minimize multiple signal response (ghosts) and to select the maximum field position in space. Additionally, if height position is used, it enhances these two capabilities. FIG. 8 shows a suitable universal joint 34 comprising a pair of plate members 35, 36 adjustably spaced by means of threaded spacer 37. Each member has at opposite ends suitable openings which are mutually aligned to form sockets within which are received ball-extensions 40 and 41. Extension 41 extends from wall support 29 while extension 40 is suitably affixed to substrate 30.

In effect, the antenna is a fine field probe sensor. While the output is shown as a 300 ohm line across terminals X and Y mounted to substrate 30, it has been found that other characteristic impedance twin-conductor lines also yield excellent response.

Referring to FIG. 6, inasmuch as there is an open in the helical loop configuration at $\phi$=180°, the miniaturized antenna of the present invention may be considered as comprising a plurality of arcuate segments each having a first and second end. The first end of segment 21 designated X represents one of the antenna termination points, while the second end of segment 21 terminates at the junction point 1 displaced approximately 180° with respect to the antenna termination point X. The second segment 22 starts at junction 1′ and makes almost a complete loop terminating at junction point 2. Likewise, segments 23, 24 and 25 represent substantially complete loops extending between junction points 2 –3, 3 —4 and 4 –5, respectively. A final arcuate segment extends between junction point 5 and the Y terminal of the antenna. In operation, the X—Y terminals are conveniently connected to the input of a receiver or transmitter, as the case may be, with which the antenna is associated.

It should be noted that terminals 1–5 and 1 –5 are adjacent to and closely spaced to each other at 180 . This arrangement may easily be fabricated by utilizing a conventional terminal board, not shown, mounted to substrate 30. Impedance means 31, preferably in the form of a variable capacitor, is connected across terminals 4–4 so as to place it in series with arcuate segments 24 and 25, each of which comprise a single loop and, if necessary, the capacitor is conveniently fastened to the substrate 30.

Interconnection of selective segments or turns and the impedance 31 is effected by selective positioning of sliders 32, 33 of switch 36. To this end, certain junction points are interconnected to the switch terminals. As most clearly shown in FIG. 7, terminal 1 connects to the B terminal which is in turn jumpered to the C switch terminal. Terminal 3 is connected to the D switch terminal, while terminals 1 , 2 and 3 are connected to switch terminals A , D and C , respectively. While the interconnection of the segments and impedance element is shown as being accomplished by means of a slide switch, other forms of switches can be conveniently substituted to achieve a variety of coupling combinations of the various segments to maximize the efficiency of the antenna at a particular operating frequency.

It should be noted that the spacing between turns it not extremely critical. Also, the positions of the opens, and of the variable condenser, can be changed from the point 180 and still obtain the desired response. A grid-dip meter may be used to indicate the series-resonant frequency points for any configuration and provides a rapid and simple method to design and check the antenna experimentally. In connection with this, the technique of scaling or electrodynamic similitude, in conjunction with the use of a grid-dip meter, permits one to easily design and test multi-turn loop configurations for other frequency ranges, both lower and higher than TV VHF, such as the TV UHF, the HF communication range of 2 to 30 MHZ, etc. For physically small antennas, such as the miniaturized antenna of the present invention or for smaller types such as would be used at higher frequencies, printed circuit fabricating techniques can be used advantageously for replication control and mass production. For color reception, the bandwidth is more than adequate. As a matter of fact, bandwidth can always be increased, if required, by using lossy conductors rather than good ones such as copper.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. An antenna comprising a plurality of arcuate conductive segments disposed in a spiral loop configuration, each segment having first and second ends, the first end of a first segment and the first end of a second segment forming antenna termination points, impedance means serially connected between a pair of said segments and selectively actuable multi-position switch means for electrically interconnecting selected segments and the impedance means.

2. An antenna as set forth in claim 1 wherein said impedance means is a capacitor.

3. An antenna as set forth in claim 1 wherein said impedance means has a variable impedance.

4. An antenna as set forth in claim 1 wherein said antenna termination points are disposed approximately at a fixed reference point of 0 with respect to said loop and the second ends of said first and said second segments and the first and second ends of the remaining segments are disposed at a position of 180 with respect to the antenna termination points.

5. An antenna as set forth in claim 1 wherein said impedance means is connected in series with two segments each forming substantially a complete loop.

6. An antenna as set forth in claim 2 wherein said capacitor is variable.

7. An antenna as set forth in claim 2 wherein said capacitor has a value in the range of 1.4 to 20mmf.

8. An antenna as set forth in claim 1 wherein a maximum dimension of said turns is less than 0.07 over a 10–1 frequency range.

9. An antenna as set forth in claim 1 wherein said antenna has a maximum loop diameter of less than 5 inches.

10. An antenna as set forth in claim 1 further including means for supporting the turns in a common plane.

11. An antenna as set forth in claim 10 further including means for adjustably positioning said turn supporting means.

12. An antenna as set forth in claim 11 wherein said means for adjustably positioning said turn supporting means comprises a universal connection.

13. An antenna as set forth in claim 1 wherein said selectively actuable multi-position switch means comprises a slider switch.

14. An antenna as set forth in claim 1 wherein said plurality of conductive segments are closely spaced in a common plane so as to exhibit strong mutual coupling between selected interconnected turns thereby maximizing the efficiency of the antenna at a particular operating frequency.

15. An antenna as set forth in claim 14 wherein a maximum dimension of said turns is less than 0.07 over a 10-1 frequency range.

16. An antenna as set forth in claim 14 wherein said switch means is actuated to a position for electrically interconnecting at least three turns in a series-connected loop, said series-connected loop including said impedance means.

17. An antenna as set forth in claim 16 wherein said impedance means is a capacitor.

18. An antenna as set forth in claim 17 wherein said capacitor is variable.

19. An antenna as set forth in claim 17 wherein said capacitor has a value in the range of 1.4 to 20 mmf.

* * * * *

UNITED STATES PATENT AND TRADEMARK OFFICE

CERTIFICATE OF CORRECTION

PATENT NO. : 3,956,751

DATED : May 11, 1976

INVENTOR(S) : Julius Herman

It is certified that error appears in the above–identified patent and that said Letters Patent are hereby corrected as shown below:

| Column No. | Correction |
|---|---|
| 4 | Line 32 Change "scaler" to "scalar" |
| 4 | Equation for $rE_\theta$; second summation is: $k = 1, 2, \cdots$ not $K = 1, 2, \cdots$ |
| 5 | Line 40 Change $12_0\pi$ to $120\pi$ |
| 5 | Line 49 Change "$H_n(\beta_0 r)$ = derivative of $H_n(\beta_0 r)$" to "$\hat{H}_n'(\beta_0 r)$ = derivative of $\hat{H}_n(\beta_0 r)$" |
| 6 | Equation (2) second relation, Change $I\phi$ to $I(\phi)$ |
| 9 | Equation (17) third relation; Change $V_{180°} Y_{80°}$ to $V_{180°} Y_{180°}$ |
| 9 | Second line from bottom. Change $a$ to $\phi_a$ |
| 9 | Bottom line; Change $Ak$ to $a_k$ |
| 10 | Line 1; Change $[a_k \cos k\phi n + b_k \sin k\phi a]$ to $[a_k \cos k\phi_a + b_k \sin k\phi_a]$ |
| 10 | Line 1; Change "$\phi a$" at end of line to "$\phi_a$" |
| 10 | Line 4; Change "three" to "there" |
| 12 | Equation (30) Rewrite as follows: $e^{-j(\beta_0 d_{(x,y,z)} - k_0 r_0)} = e^{j\beta_0 c \sin\theta_0 \cos(\phi_0 - \phi_I)}$ |
| 12 | Equations (31) and (32), place parentheais in $\cos\phi_0 - \phi_I$ around $\phi_0 - \phi_I$ or $\cos(\phi_0 - \phi_I)$ |
| 12 | Equation (34) Change the large C before the integral to a small c |
| 12 | Equation (36) The upper limit on the summation is $\infty$ not $\alpha$ |
| 12 | Equation (37) The upper limit on each summation is $\infty$ not $\alpha$ |
| 13 | Second line from top; Change $V_\ell/T(0°)$ to $V_\ell/I(0°)$ |
| 14 | Equation (47) Change "$F_p$" at the end of the numerator to "$E_p$" |
| 15 | Line 37 Change "ratios and mode" to "ratios of mode" |
| 15 | Line 60 Change the first word "that" to "the" |

UNITED STATES PATENT AND TRADEMARK OFFICE

CERTIFICATE OF CORRECTION

PATENT NO. : 3,956,751

DATED : May 11, 1976

INVENTOR(S) : Julius Herman

It is certified that error appears in the above-identified patent and that said Letters Patent are hereby corrected as shown below:

| Column No. | Correction |
|---|---|
| 17 | Equation (33) Change the first term on the right, "$-E^{I}$", to "$-E^{I}_{\phi_p}$" |
| 17 | Equation (13) Change upper limit on summation from $\alpha$ to $\infty$ Also, at end of equation, add $p = 1 \cdots m$ instead of $1 \cdots m$ |
| 18 | Equation (52) Change upper limit on summation from $\alpha$ to $\infty$ |
| 18 | Line (21) After "accuracy", change comma to a period |
| 18 | Equation (58) The $-1$ on the bottom of the page should be taken out |
| 19 | Equation (59) Add the exponent "$-1$" to the $Z_{kmm}$ matrix on the right side. Also add continuation dashes in the $M_{kmm}$ matrix |
| 19 | Equation (61) In the final term in brackets on the lower left side, change $\varepsilon_m \int_0^{2\pi}$ to $c_m \int_0^{2\pi}$ |
| 19 | Line 59 Change "an" at the end of the line to "and" |
| 20 | Equation (62) In both bracket terms, change the term $E_\phi$ to $E'_{\phi_p}$ |
| 20 | Line 53 Change $Y_{180°}$ $Y_{q180°}$ to $Y_{q180°}$ $Y_{q180°}$ |
| 21 | Third line from top; change single long dash between "turn 1 ——— turn m" to a series of short dashes, or "turn 1 - - - - - turn m" |
| 23 | Change the headings on the first table as follows: $\cos 2\pi y\,(sp/\ell)$ to $\cos 2\pi y\,(sp/L)$ $\sin 2\pi y\,(sp/\ell)$ to $\sin 2\pi y\,(sp/L)$ |
| 24 | In the last heading in the table, delete $i$ in front of $ks/b_e$ Also, close the parentheses in the term below this heading, $k(2\pi - 3\theta/R_2)$ |
| 25 | Line 14 Change "$bk's$" to "$b_k's$" |
| 25 | Line 17 Insert "it" between "That" and "is" |

UNITED STATES PATENT AND TRADEMARK OFFICE

CERTIFICATE OF CORRECTION

PATENT NO. : 3,956,751

DATED : May 11, 1976

INVENTOR(S) : Julius Herman

It is certified that error appears in the above-identified patent and that said Letters Patent are hereby corrected as shown below:

| Column No. | | Correction |
|---|---|---|
| 25 | Line 63 | In step f, change $V_q$ to $V_{q180°}$ |
| | Line 64 | In step f, change $m_{qqp}$'s to $M_{qqp}$'s |
| | Line 65 | In step f, change $V_q$ to $V_{q180°}$ |
| 25 | Line 66 | In step g, change $V_q$ to $V_{q180°}$ |
| 27 | Equation (83) | The left side is $X_{1pp}$ not $X_{1pq}$ |
| 29 | Line 29 | Change "similtude" to "similitude" |
| 31 | Line 4 | Change 2-3, 3-4, and 4-5 to 2'-3, 3'-4, and 4'-5 |
| 31 | Line 5 | Change 5 to 5' |
| 31 | Line 10 | Change the second 1-5 to 1'-5' |
| 31 | Line 11 | Change 180 to $\phi = 180°$ |
| 31 | Line 16 | Change 4-4 to 4-4' |
| 31 | Line 25 | Change B to B' |
| 31 | Line 26 | Change D to D' |
| 31 | Line 27 | Change 1, 2 and 3 to 1', 2', and 3' |
| 31 | Line 28 | Change A, D, and C to A', D and C' |
| 31 | Line 36 | Change "it" at end of line to "is" |
| 31 | Line 39 | Change 180 to $\phi = 180°$ |
| 32 | Claim 4 | Change 0 to $\phi = 0°$. Also change 180 to $\phi = 180°$ |
| 32 | Claim 8 | Change 0.07 to 0.07 $\lambda$ |
| 32 | Claim 15 | Change 0.07 to 0.07 $\lambda$ |

Signed and Sealed this

Twenty-fourth Day of August 1976

[SEAL]

*Attest:*

RUTH C. MASON
*Attesting Officer*

C. MARSHALL DANN
*Commissioner of Patents and Trademarks*